US005692525A

United States Patent [19]

Counts et al.

[11] Patent Number: 5,692,525

[45] Date of Patent: Dec. 2, 1997

[54] CIGARETTE FOR ELECTRICAL SMOKING SYSTEM

[75] Inventors: Mary Ellen Counts; Willie G. Houck, Jr., both of Richmond; Michael A. Moore, Midlothian; Wesley G. Sanderson, Richmond; Michael L. Watkins, Chester; Susan E. Wrenn, Chesterfield, all of Va.

[73] Assignee: Philip Morris Incorporated, New York, N.Y.

[21] Appl. No.: 425,166

[22] Filed: Apr. 20, 1995

Related U.S. Application Data

[60] Division of Ser. No. 425,166, Apr. 20, 1995, which is a continuation-in-part of Ser. No. 380,718, Jan. 30, 1995, which is a continuation of Ser. No. 118,665, Sep. 10, 1993, Pat. No. 5,388,594, which is a continuation-in-part of Ser. No. 943,504, Sep. 11, 1992, Pat. No. 5,505,214.

[51] Int. Cl.[6] ..... A24F 47/00

[52] U.S. Cl. ..... 131/194

[58] Field of Search ..... 131/360, 194, 131/361, 364, 331, 344

[56] References Cited

U.S. PATENT DOCUMENTS

| | | |
|---|---|---|
| 1,771,336 | 7/1930 | Wyss et al. . |
| 1,968,509 | 7/1934 | Tiffany . |
| 2,057,353 | 10/1936 | Whittemore, Jr. . |
| 2,104,266 | 1/1938 | McCormick . |
| 2,442,004 | 5/1948 | Hayward-Butt . |
| 2,974,669 | 3/1961 | Ellis . |
| 3,200,819 | 8/1965 | Gilbert . |
| 3,255,760 | 6/1966 | Selke . |
| 3,363,633 | 1/1968 | Weber . |
| 3,402,723 | 9/1968 | Hu . |
| 3,482,580 | 12/1969 | Hollebaugh . |
| 3,496,336 | 2/1970 | Hingorany et al. . |
| 3,591,753 | 7/1971 | Gartner . |
| 3,608,560 | 9/1971 | Briskin . |
| 3,738,374 | 6/1973 | Bennett . |
| 3,744,496 | 7/1973 | McCarty et al. . |
| 3,804,100 | 4/1974 | Fariello . |
| 3,889,690 | 6/1975 | Guarnieri . |
| 4,016,061 | 4/1977 | Wasa et al. . |
| 4,068,672 | 1/1978 | Guerra . |
| 4,077,784 | 3/1978 | Vayrynen . |
| 4,131,119 | 12/1978 | Blasutti . |

(List continued on next page.)

FOREIGN PATENT DOCUMENTS

| | | |
|---|---|---|
| 1202378 | 3/1986 | Canada . |
| 87/104459 | 2/1988 | China . |
| 0 295 122 | 12/1988 | European Pat. Off. . |
| 0 358 002 | 3/1990 | European Pat. Off. . |
| 0 358 114 | 3/1990 | European Pat. Off. . |
| 0 430 566 A2 | 6/1991 | European Pat. Off. . |
| 0 438 862 A2 | 7/1991 | European Pat. Off. . |
| 3 640 917 | 8/1988 | Germany . |
| 3 735 704 | 5/1989 | Germany . |
| 61-68061 | 4/1986 | Japan . |
| 2 132 539 | 7/1984 | United Kingdom . |
| 2 148 079 | 5/1985 | United Kingdom . |
| 2 148 676 | 5/1985 | United Kingdom . |
| WO 86/02528 | 5/1986 | WIPO . |
| WO 95/05094 | 2/1995 | WIPO . |

*Primary Examiner*—Jennifer Bahr

*Attorney, Agent, or Firm*—Charles E. B. Glenn; James E. Schardt; James T. Moore

[57] ABSTRACT

A cigarette adapted for use in an electrical cigarette system having a tobacco rod having filled and unfilled tobacco rod portions and being arranged so that electrical heater elements may overlap the filled and unfilled tobacco rod portions. The tobacco rod includes a tobacco web rolled into tubular form. The tobacco web is constructed in accordance with a process having the steps of converting tobacco feedstock into a continuous sheet of tobacco web and converting the continuous sheet of tobacco web into one or more bobbins of tobacco web suitable for automated manufacture of cigarettes.

14 Claims, 16 Drawing Sheets

U.S. PATENT DOCUMENTS

| | | | |
|---|---|---|---|
| 4,141,369 | 2/1979 | Burruss . | |
| 4,164,230 | 8/1979 | Pearlman . | |
| 4,193,411 | 3/1980 | Faris et al. | 131/171 |
| 4,194,108 | 3/1980 | Nakajima et al. | 219/216 |
| 4,203,025 | 5/1980 | Nakatani et al. | 219/216 |
| 4,215,708 | 8/1980 | Bron | 131/262 |
| 4,219,032 | 8/1980 | Tabatznik et al. | 131/170 |
| 4,246,913 | 1/1981 | Ogden et al. | 131/171 |
| 4,256,945 | 3/1981 | Carter et al. | 219/10.75 |
| 4,259,564 | 3/1981 | Ohkubo | 219/216 |
| 4,259,970 | 4/1981 | Green, Jr. | 131/330 |
| 4,303,083 | 12/1981 | Burruss, Jr. | 131/271 |
| 4,319,591 | 3/1982 | Keith et al. | 131/359 |
| 4,393,884 | 7/1983 | Jacobs | 131/273 |
| 4,431,903 | 2/1984 | Riccio | 219/238 |
| 4,436,100 | 3/1984 | Green, Jr. | 131/330 |
| 4,463,247 | 7/1984 | Lawrence et al. | 219/236 |
| 4,505,282 | 3/1985 | Cogbill et al. | 131/334 |
| 4,510,950 | 4/1985 | Keritsis et al. . | |
| 4,562,337 | 12/1985 | Lawrence | 219/421 |
| 4,570,646 | 2/1986 | Herron | 131/185 |
| 4,580,583 | 4/1986 | Green, Jr. | 131/330 |
| 4,621,649 | 11/1986 | Osterrath | 131/185 |
| 4,623,401 | 11/1986 | Derbyshire et al. | 148/13 |
| 4,629,604 | 12/1986 | Spector | 422/124 |
| 4,637,407 | 1/1987 | Bonanno et al. | 131/175 |
| 4,659,912 | 4/1987 | Derbyshire . | |
| 4,682,010 | 7/1987 | Drapeau et al. . | |
| 4,686,353 | 8/1987 | Spector . | |
| 4,692,590 | 9/1987 | Spector . | |
| 4,694,824 | 9/1987 | Ruderian . | |
| 4,735,217 | 4/1988 | Gerth et al. . | |
| 4,771,796 | 9/1988 | Myer . | |
| 4,776,353 | 10/1988 | Lilja et al. . | |
| 4,837,421 | 6/1989 | Luthy . | |
| 4,846,199 | 7/1989 | Rose . | |
| 4,848,376 | 7/1989 | Lilja et al. . | |
| 4,874,924 | 10/1989 | Yamamoto et al. . | |
| 4,877,989 | 10/1989 | Drews et al. . | |
| 4,922,901 | 5/1990 | Brooks et al. . | |
| 4,945,931 | 8/1990 | Gori . | |
| 4,947,874 | 8/1990 | Brooks et al. . | |
| 4,947,875 | 8/1990 | Brooks et al. . | |
| 4,966,171 | 10/1990 | Seranno et al. . | |
| 4,981,522 | 1/1991 | Nichols et al. . | |
| 4,991,606 | 2/1991 | Seranno et al. . | |
| 4,998,541 | 3/1991 | Perfetti et al. . | |
| 5,016,656 | 5/1991 | McMurtrie . | |
| 5,040,552 | 8/1991 | Schleich et al. . | |
| 5,042,510 | 8/1991 | Curtiss et al. . | |
| 5,060,671 | 10/1991 | Counts et al. . | |
| 5,076,296 | 12/1991 | Nystrom et al. . | |
| 5,093,894 | 3/1992 | Deevi . | |
| 5,095,921 | 3/1992 | Losee et al. . | |
| 5,144,962 | 9/1992 | Counts et al. . | |
| 5,159,940 | 11/1992 | Hayward et al. . | |
| 5,179,966 | 1/1993 | Losee et al. . | |
| 5,188,130 | 2/1993 | Hajaligol et al. . | |
| 5,224,498 | 7/1993 | Deevi et al. . | |
| 5,235,157 | 8/1993 | Blackburn . | |
| 5,249,586 | 10/1993 | Morgan et al. . | |
| 5,269,327 | 12/1993 | Counts et al. . | |
| 5,274,214 | 12/1993 | Blackburn . | |
| 5,285,050 | 2/1994 | Blackburn . | |
| 5,388,594 | 2/1995 | Counts et al. . | |
| 5,479,948 | 1/1996 | Counts et al. . | |

CIGARETTE FOR ELECTRICAL SMOKING SYSTEM

CROSS REFERENCE TO RELATED APPLICATIONS

This application is a divisional of application Ser. No. 08/425,166 filed Apr. 20, 1995, which is a continuation-in-part of commonly assigned, copending patent application Ser. No. 08/380,718, filed Jan. 30, 1995, still pending which is a continuation of U.S. Pat. No. 5,388,594 which issued from Ser. No. 08/118,665, filed Sep. 10, 1993, the latter being a continuation-in-part of commonly assigned patent application Ser. No. 07/943,504, filed Sep. 11, 1992, now U.S. Pat. No. 5,505,214, all which are hereby incorporated by reference in their entireties.

The present application relates to commonly assigned patent application Ser. No. 07/943,747, filed Sep. 11, 1992 (which issued Nov. 29, 1994, as U.S. Pat. No. 5,369,723) to commonly assigned U.S. Pat. No. 5,060,671, issued Oct. 29, 1991; to commonly assigned U.S. Pat. No. 5,095,921, issued Mar. 17, 1992; and to commonly assigned U.S. Pat. No. 5,224,498, issued Jul. 6, 1992; all which are hereby incorporated by reference in their entireties.

The present application is also related to the commonly assigned, co-pending U.S. Ser. No. 08/426,165, which is filed concurrently herewith and entitled, "Heater For Electrical Smoking System"; and the present application is related to the commonly assigned, co-pending U.S. Ser. No. 08/426,006, which is filed concurrently herewith and entitled, "Iron Aluminide Alloys Useful as Electrical Resistance Heating Elements". These related applications Ser. No. 08/426,165 (which issues Jan. 7, 1997, as U.S. Pat. No. 5,591,368) and Ser. No. 08/426,006 are hereby incorporated by reference in their entireties.

FIELD OF INVENTION

The present invention relates generally to electrical smoking systems, and in particular cigarettes adapted to cooperate with electrical lighters of electrical smoking systems.

BACKGROUND OF THE INVENTION

Traditional cigarettes deliver flavor and aroma to the smoker as a result of combustion, during which a mass of tobacco is combusted at temperatures which often exceeds 800° C. during a puff. The heat of combustion releases various gaseous combustion products and distillates from the tobacco. As these gaseous products are drawn through the cigarette, they cool and condense to form an aerosol which provides the tastes and aromas associated with smoking.

Traditional cigarettes produce sidestream smoke during smoldering between puffs. Once lit, they must be fully consumed or be discarded. Re-lighting a traditional cigarette is possible but is usually an unattractive proposition to a discerning smoker for subjective reasons (flavor, taste, odor).

An alternative to the more traditional cigarettes includes those in which the combustible material itself does not itself release the tobacco aerosol. Such smoking articles may comprise a combustible, carbonaceous heating element (heat source) located at or about one end of the smoking article and a bed of tobacco-laden elements located adjacent the aforementioned heating element. The heating element is ignited with a match or cigarette lighter, and when a smoker draws upon the cigarette, heat generated by the heating element is communicated to the bed of tobacco-laden elements so as to cause the bed to release a tobacco aerosol. While this type of smoking device produces little or no sidestream smoke, it still generates products of combustion at the heat source, and once its heat source is ignited, it is not readily snuffed for future use in a practical sense.

Copending and commonly assigned, U.S. patent applications Ser. No. 08/380,718, filed Jan. 30, 1995 and Ser. No. 07/943,504, filed Sep. 11, 1992 disclose various heating elements and flavor generating articles which significantly reduce sidestream smoke while permitting the smoker to selectively suspend and reinitiate smoking.The parent of the former application issued Feb. 14, 1995, as U.S. Pat. No. 5,388,594, and the latter application issued Apr. 9, 1996 as U.S. Pat. No. 5,505214.

The aforementioned, United States patent application Ser. No. 08/380,718 describes an electrical smoking system including a novel electrically powered lighter and a novel cigarette that cooperates with the lighter. The preferred embodiment of the lighter includes a plurality of metallic serpentine heaters disposed in a configuration that slidingly receives a tobacco rod portion of the cigarette.

The preferred embodiment of the cigarette in Ser. No. 08/380,718 comprises a tobacco-laden tubular carrier, a cigarette paper overwrapped about the tubular carrier, an arrangement of flow-through filter plugs at a mouthpiece end of the carrier and a filter plug at the free (distal) end of the carrier. The cigarette and the lighter are configured such that when the cigarette is inserted into the lighter and as individual heaters are activated for each puff, localized charring occurs at spots about the cigarette in the locality where each heater was bearing against the cigarette (hereinafter referred to as a "heater footprint"). Once all the heaters have been activated, these charred spots are closely spaced from one another and encircle a central portion of the carrier portion of the cigarette.

When we included cut filler with the hollow structure of the cigarette in Ser. No. 08/380,718, it was discovered that such cigarettes when fully filled with cut filler tobacco tended to operate adequately in an electrical lighter for the first several puffs. Thereafter, its delivery would tend to taper off. The same phenomenon would tend to occur when more traditional cigarettes were smoked in an electrical lighter such as the electrical lighter disclosed in U.S. Ser. No. 08/380,718.

When left unfilled, the hollow cigarette structures of the preferred embodiments of Ser. No. 08/380,718 were also somewhat vulnerable to collapse from extreme or rough handling.

SUMMARY OF THE INVENTION

Accordingly, a primary object of the present invention is to provide a novel cigarette which contains cut filler and yet is operable with consistency when smoked as part of an electrical smoking system.

Another object of the present invention is to provide a cigarette containing cut filler, which cigarette is adapted to cooperate with an electrical lighter and render satisfying levels of taste and delivery.

Yet another object of the present invention is to provide a cigarette for an electrical smoking system which includes cut filler, yet provides improved consistency in delivery from puff to puff.

Still another object of the present invention is to provide a smoking article which is readily manufactured and packed into attractive packaging.

It is a still further object of the present invention to provide a cigarette which is physically robust and minimizes condensation and/or filtration of aerosol within the cigarette and/or the lighter.

Another object of the present invention is to provide a cigarette adapted for use in electrical smoking systems, which cigarette is resistive to breakage during the withdrawal of the cigarette from the lighter thereof.

It is another object of the present invention to provide a cigarette suited for consumption with a lighter of an electrical smoking system, wherein the cigarette itself is less vulnerable to collapse or breakage during rough handling by the consumer.

It is another object of the present invention to provide a cigarette suited for consumption with a lighter of an electrical smoking system wherein the cigarette itself is not prone to collapse or breakage during the manufacture or packing of the cigarette.

It is still a further object of this invention to provide a novel cigarette that is operative with an electrical lighter and conducive to cost-effective methods of manufacture, even at production speeds.

These objects and other advantages are provided by the present invention which provide a smoking system for delivering a flavored tobacco response to a smoker. The system includes a cigarette and an electrically operated lighter, which lighter includes a plurality of electrical heaters, with each of the heaters being adapted to, either singularly or in concert, to thermally release a predetermined quantity of tobacco aerosol from the cigarette upon its/their activation.

In accordance with one aspect of the present invention, the cigarette comprises a tubular tobacco web, wherein a first portion of the tubular tobacco web is filled with a column of tobacco, preferably in the form of cut filler, and a second portion of the tubular tobacco web is left unfilled or hollow so as to define a void in the tobacco column.

More particularly, the aforementioned cigarette preferably comprises a tobacco rod formed from a tubular tobacco web and a plug of tobacco located within the tubular tobacco web. The tobacco rod is adapted to be slidingly received by an electrical heater fixture such that the heater elements locate alongside the tobacco rod at a location between the free end and an opposite end of the tobacco rod. Preferably the plug (or column) of tobacco extends from the free end of the tobacco rod to a location that is spaced from the opposite end of the tobacco rod so as to define a void (or hollow portion) adjacent the opposite end.

The relative dimensions of the cigarette and the heater fixture of the lighter are determined such that upon insertion of the cigarette into the lighter, each heater will locate alongside the tobacco rod at a predetermined location along the tobacco rod and, preferably, such that the longitudinal extent of contact between the heater and the cigarette (hereinafter "heater footprint") superposes at least a portion of the aforementioned void and at least a portion of the plug of tobacco. In so doing, consistent and satisfactory delivery is obtained when the cigarette is electrically smoked, and condensation of tobacco aerosol at or about the heater elements is reduced.

In the alternative, the relative dimensions of the cigarette and the heater fixture of the lighter are determined such that upon insertion of the cigarette into the lighter, each heater will locate alongside the tobacco rod such that at least some, if not all of the heater footprints superpose only the filled portion of the tobacco rod (over the tobacco plug). In such configurations, the void may still be employed to facilitate aerosol formation and to help cool the smoke.

Preferably, a cigarette paper is wrapped about the tubular tobacco web so as to provide the appearance and feel of the more traditional cigarette during handling by the smoker.

The tobacco web preferably comprises a nonwoven tobacco base web and a layer of tobacco material located along at least one side of the tobacco base web.

The cigarette preferably also includes filter tipping at the aforementioned opposite end of the tobacco rod, which comprises a flow-through filter plug (also known in the art as "whistle-through" plugs), a mouthpiece filter plug and tipping paper attaching the plugs to the tobacco rod.

When a cigarette of the present invention is inserted into a lighter of an electrical smoking system, the cigarette registers against a stop located within the heater fixture of the lighter (or at some equivalent registration) so that the electrical heating elements of the lighter locate consistently alongside the cigarette at generally the same location for each cigarette. As a puff is initiated, at least one of the heaters of the lighter is responsively activated to heat the cigarette at the aforementioned location along the tobacco rod. As a puff progresses, the tobacco rod is heated and aerosol is driven off the tobacco web and the filler. Where the heater footprint superposes the void in the tobacco rod, tobacco aerosol is almost immediately released into the space defined within the unfilled portion of the tobacco rod and drawn out of the cigarette. The tobacco web contributes most of this fraction of the total aerosol delivered by the cigarette and its immediacy is believed to favorably affect the nature and extent of the smoker's draw on the cigarette. Because of the greater mass of tobacco at the filled portion of the tobacco rod, there is a slight delay in the release of aerosol from where the heater footprint superposes the filled portion of the rod. The aerosol which is driven off the filled portion of the tobacco rod contributes an additional, dominating flavor and character to the smoke.

A further aspect of the present invention is the capacity to adjust delivery of a cigarette of an electrical smoking system, wherein the proportional amount of overlap between the filled and unfilled portions of the tobacco rod by the heater footprint effects desired adjustments in delivery from one brand of cigarette to another or within line extensions of the same brand.

Yet another aspect of the present invention is a method of improving levels and consistency of delivery of aerosol from a cigarette operated with an electronic heater device, wherein the cigarette has a free end and an opposite end. The method comprises the steps of superposing a heater footprint over both a tobacco-filled portion of the cigarette adjacent the free end and an unfilled portion of the cigarette adjacent the opposite end, while simultaneously resistively heating along the heater footprint and drawing on the cigarette through the opposite end thereof.

Still another aspect of the present invention is to provide a filler containing cigarette that is operative with an electrical lighter, which cigarette includes a tobacco rod having a free-flow filter and a filler-free rod portion adjacent the free flow filter so as to promote consistent aerosol production.

Another aspect of the present invention is a reinforced tubular tobacco web having flax or wood cellulosic fiber added to its base web so as to provide additional strength. In the alternative, cellulosic fiber from tobacco stem feedstock may be included in the composition of the base web as a reinforcing agent.

Robustness of the cigarette is improved by the inclusion of cut filler within the confines of its tubular tobacco web so as to provide a cigarette which can better withstand handling, including handling by cigarette manufacturing machines and by consumers.

BRIEF DESCRIPTION OF THE DRAWING

Other objects, advantages and novel features of the present invention will become apparent from the following detailed description of the preferred embodiments when considered in conjunction with the accompanying drawings, wherein:

FIG. 5B shows the steps of converting the tobacco web sheet into bobbins of tobacco web;

DETAILED DESCRIPTION OF THE PREFERRED EMBODIMENTS

Figure 1:
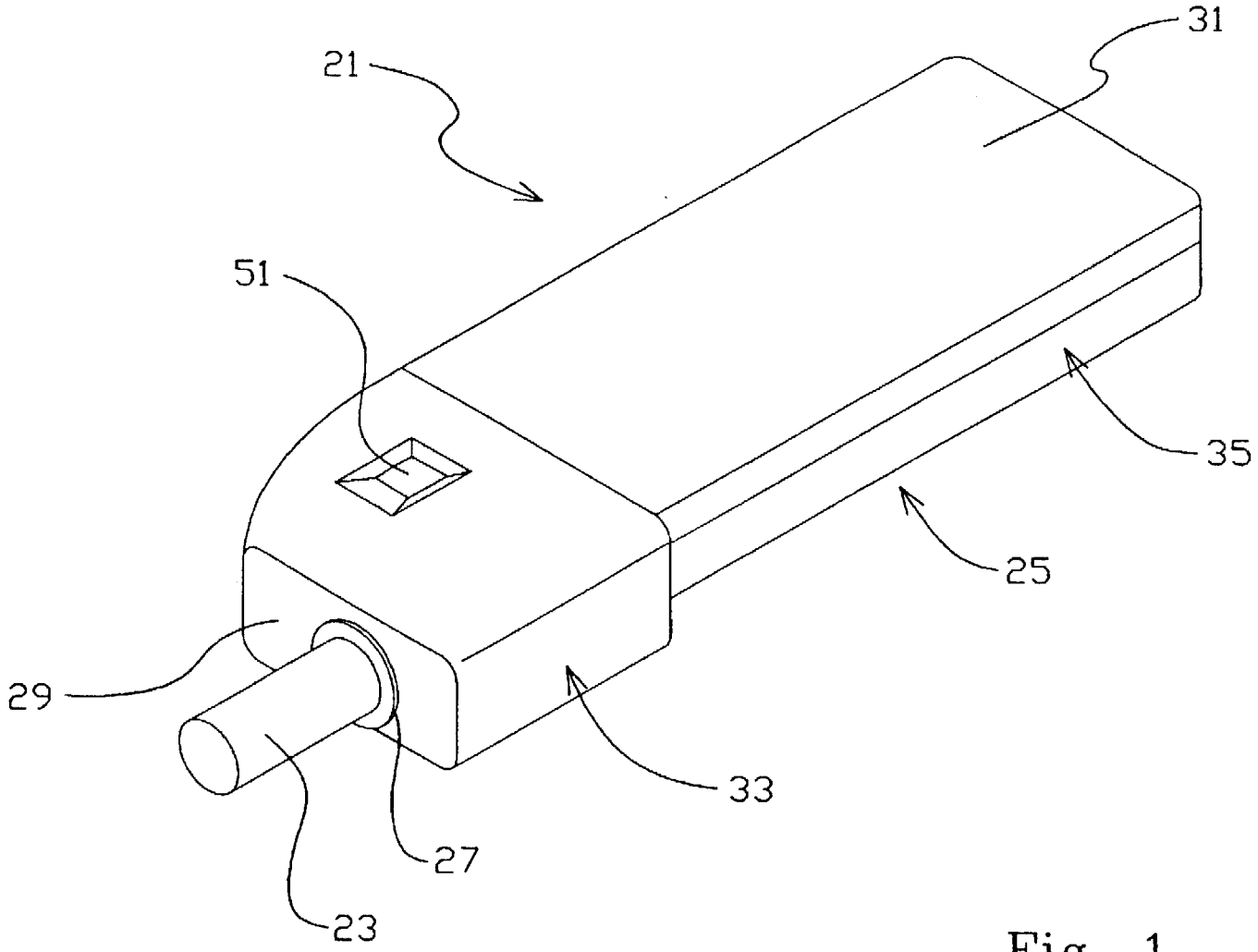
FIGS. 1 and 2 are perspective views of an electronic smoking system in accordance with a preferred embodiment of the present invention.
Figure 2:
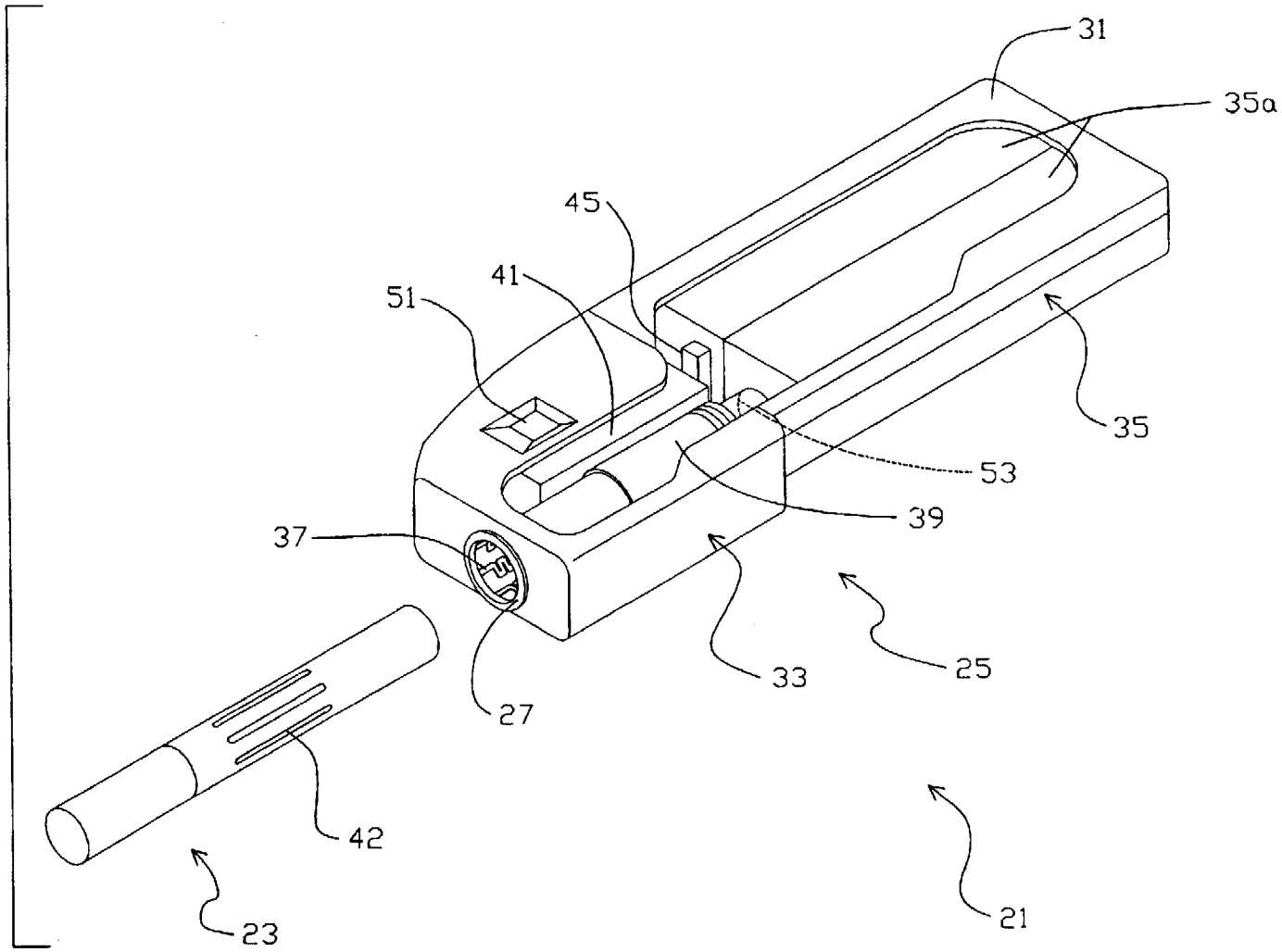

Referring to FIGS. 1 and 2, a preferred embodiment of the present invention provides a smoking system 21 which includes a partially-filled, filler cigarette 23 and a reusable lighter 25. The cigarette 23 is adapted to be inserted into and removed from a receptacle 27 at a front end portion 29 of the lighter 25. Once the cigarette 23 is inserted, the smoking system 21 is used in much the same fashion as a more traditional cigarette, but without lighting or smoldering the cigarette 23. The cigarette 23 is discarded after one or more puff cycles. Preferably, each cigarette 23 provides a total of eight puffs (puff cycles) or more per smoke; however it is a matter design expedient to adjust to a lesser or greater total number of available puffs.

The lighter 25 includes a housing 31 having front and rear housing portions 33 and 35. One or more batteries **35*a* are removably located within the rear housing portion 35 and supply energy to a plurality of electrically resistive, heating elements 37 which are arranged within the front housing portion 33 adjacent the receptacle 27. A control circuit 41 in the front housing portion 33 establishes electrical communication between the batteries 35*a* and the heater elements 37. Preferably, the rear portion 35** is adapted to be readily opened and closed, such as with screws or snap-fit components, to facilitate replacement of the batteries. If desired, an electrical socket or contacts may be provided for recharging the batteries with house current or the like.

Preferably, the front housing portion 33 is removably joined to the rear housing portion 35, such as with a dovetail joint or a socket fit. The housing 31 is preferably made from a hard, heat-resistant material. Preferred materials include metallic or, more preferably, polymeric materials. Preferably, the housing 31 has overall dimensions of about 10.7 cm by 3.8 cm by 1.5 cm. so that it may fit comfortably in the hand of a smoker.

The batteries **35*a* are sized to provide sufficient power for the heaters 37 to function as intended and preferably comprise a replaceable and rechargeable type. Alternate sources of power are suitable, such as capacitors. In the preferred embodiment, the power source comprises four nickel-cadmium battery cells connected in series with a total, non-loaded voltage of approximately 4.8 to 5.6 volts. The characteristics required of the power source are, however, selected in view of the characteristics of other components in the smoking system 21, particularly the characteristics of the heating elements 37**. U.S. Pat. No. 5,144,962, hereby incorporated by reference, describes several types of power sources useful in connection with the smoking system of the present invention, such as rechargeable battery sources and power arrangements which comprise a capacitor which is recharged by a battery.

Figure 3:
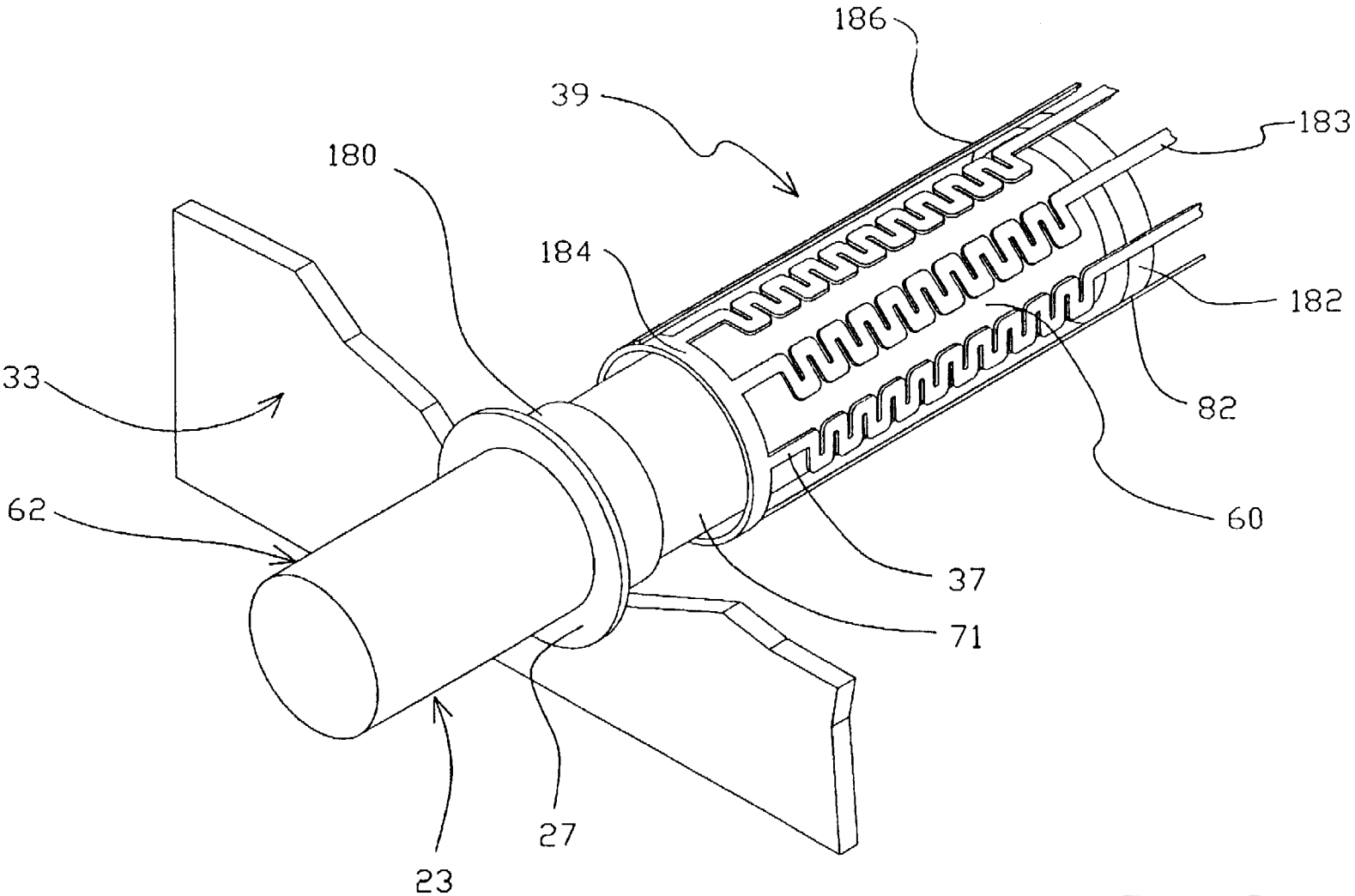
FIG. 3 is a breakaway perspective view of a cigarette engaged within the heater fixture of the smoking system shown in FIG. 1.

Referring now to FIG. 3, the front housing portion 33 of the lighter 25 supports a substantially cylindrical heater fixture 39 which slidingly receives the cigarette 23. The heater fixture 39 houses the heater elements 37 and is adapted to support an inserted cigarette 23 in a fixed relation to the heater elements 37 such that the heater elements 37 are positioned alongside the cigarette at approximately the same location along each cigarette. Where each heater element 37 bears against (or is in thermal contact with) a fully inserted cigarette 23 is referred to herein as the heater footprint.

To assure consistent placement of the heating elements 37 relative to each cigarette 23 from cigarette to cigarette, the heater fixture 39 is provided with a stop 182 against which the cigarette is urged during its placement into the lighter 25. Other expedients for registering the cigarette 23 relative to the lighter 25 could be used instead.

The front housing portion 33 of the lighter 25 also includes an electrical control circuitry 41 which delivers a predetermined amount of energy from the power source 35a to the heating elements 37. In the preferred embodiment, the heater fixture 39 includes eight circumferentially spaced-apart heating elements 37 which are concentrically aligned with the receptacle 27 and of serpentine form. Details of the heaters 37 are illustrated and described in commonly assigned U.S. Pat. No. 5,505,214, copending herewith and in commonly assigned, U.S. Pat. No. 5,388,594, both of which documents are incorporated herein by reference in their entireties. Additional heater fixtures 37 that are operable as part of the lighter 25 include those disclosed in commonly assigned, copending U.S. patent application Ser. No. 08/370,125 filed Jan. 6, 1995 in commonly assigned, U.S. Pat. No. 5,591,368 and commonly assigned, U.S. Pat. No. 5,498,855, all which documents are incorporated herein by reference in their entireties. Preferably, the heaters 37 are individually energized by the power source 35a under the control of the circuitry 41 to heat the cigarette 23 preferably eight times at spaced locations about the periphery of the cigarette 23. The heating renders eight puffs from the cigarette 23, as is commonly achieved with the smoking of a more traditional cigarette. It may be preferred to fire more than one heater simultaneously for one or more of the puffs.

Another preferred heater arrangement is set forth in co-pending, commonly assigned, U.S. patent application Ser. No. 08/224,848, filed Apr. 8, 1994, hereby incorporated by reference in its entirety.

Referring back to FIG. 2, preferably, the circuitry 41 is activated by a puff-actuated sensor 45 that is sensitive to either changes in pressure or changes in rate of air flow which occur upon initiation of a draw on the cigarette 23 by a smoker. The puff-actuated sensor 45 is preferably located within the front housing portion 33 of the lighter 25 and is communicated with a space inside the heater fixture 39 adjacent the cigarette 23 through a passageway extending through a spacer at the base of the heater fixture 39 and, if desired, a puff sensor tube (not shown). A puff-actuated sensor 45 suitable for use in the smoking system 21 is described in commonly assigned U.S. Pat. No. 5,060,671, the disclosure of which is incorporated herein by reference. The puff sensor 45 preferably comprises a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for activating an appropriate one of the heater elements 37 upon detection of a change in air flow. Once activated by the sensor 45, the control circuitry 41 directs electric current to an appropriate one of the heater elements 37.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display. In the preferred embodiment, the indicator 51 displays the digit "8" when a cigarette detector 53 detects the presence of a cigarette in the heater fixture 39. The detector 53 preferably comprises a light sensor at the base of the heater fixture 39 that detects when a beam of light is reflected off an inserted cigarette 23. Thereupon the cigarette detector 53 provides a signal to the circuitry 41 which, in turn, responsively provides a signal to the indicator 51. The display of the digit "8" on the indicator 51 reflects that the eight puffs provided on each cigarette 23 are available, i.e., none of the heater elements 37 have been activated to heat the cigarette 23. After the cigarette 23 is fully smoked, the indicator displays the digit "0". When the cigarette 23 is removed from the lighter 25, the cigarette detector 53 no longer detects a presence of a cigarette 23 and the indicator 51 is turned off. The cigarette detector 53 is modulated so that it does not constantly emit a beam of light, which would otherwise create an unnecessary drain on the power source 35a. A preferred cigarette detector 53 suitable for use with the smoking system 21 is a Type OPR5005 Light Sensor, manufactured by OPTEX Technology, Inc., 1215 West Crosby Road, Carrollton, Tex. 75006.

In the alternative to displaying the remainder of the puff count, the detector display may instead be arranged to indicate whether the system is active or inactive ("on" or "off").

As one of several possible alternatives to using the above-noted cigarette detector 53, a mechanical switch (not shown) may be provided to detect the presence or absence of a cigarette 23 and a reset button (not shown) may be provided for resetting the circuitry 41 when a new cigarette is inserted into the lighter 25, e.g., to cause the indicator 51 to display the digit "8", etc. Power sources, circuitry, puff-actuated sensors, and indicators useful with the smoking system 21 of the present invention are described in commonly assigned, U.S. Pat. No. 5,060,671 and the commonly assigned U.S. Pat. No. 5,505,214 both of which are incorporated by reference.

Figure 4A:
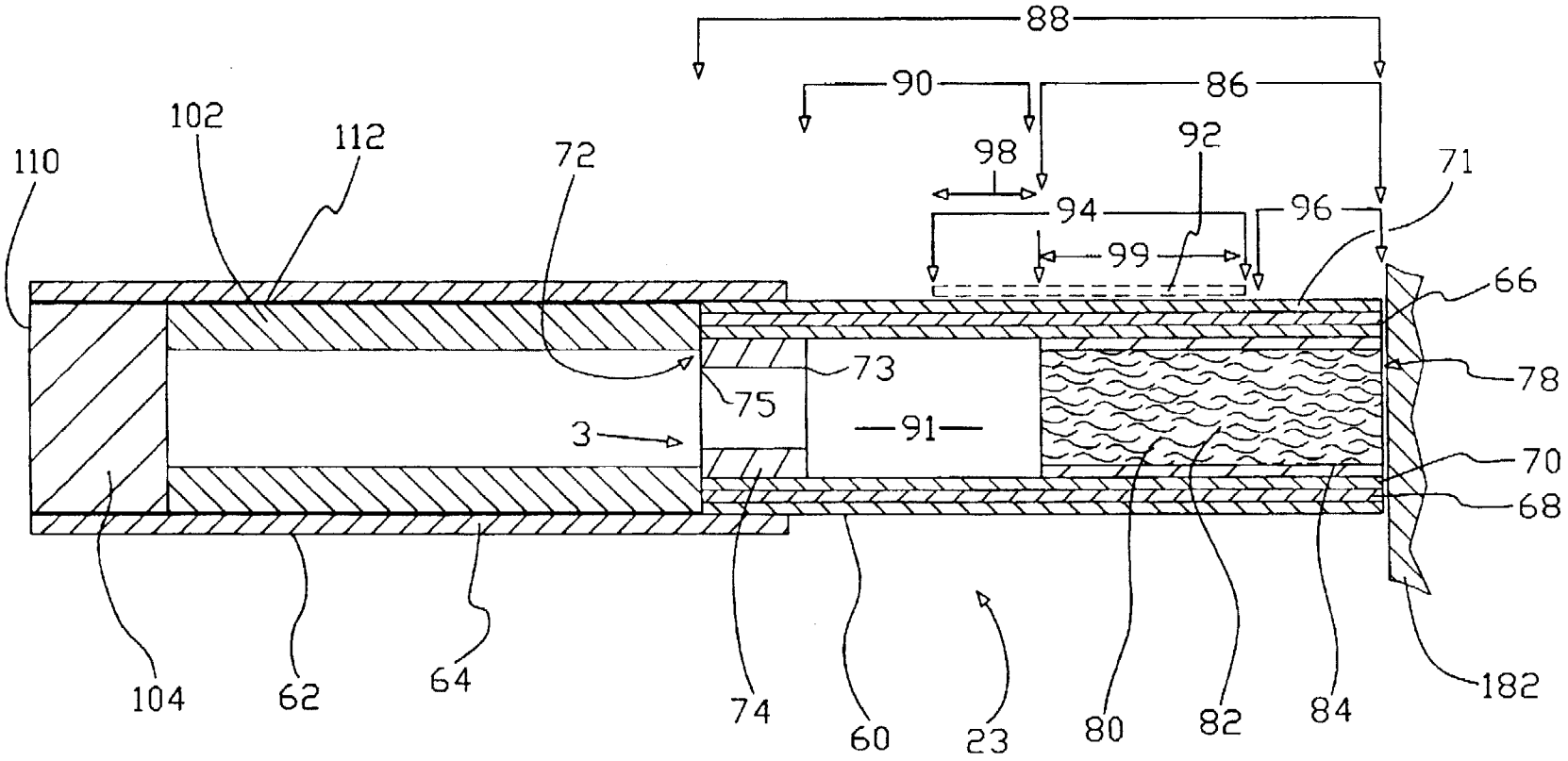
FIG. 4A is a sectional side view of a cigarette constructed in accordance with a preferred embodiment of the present invention.
Figure 4B:
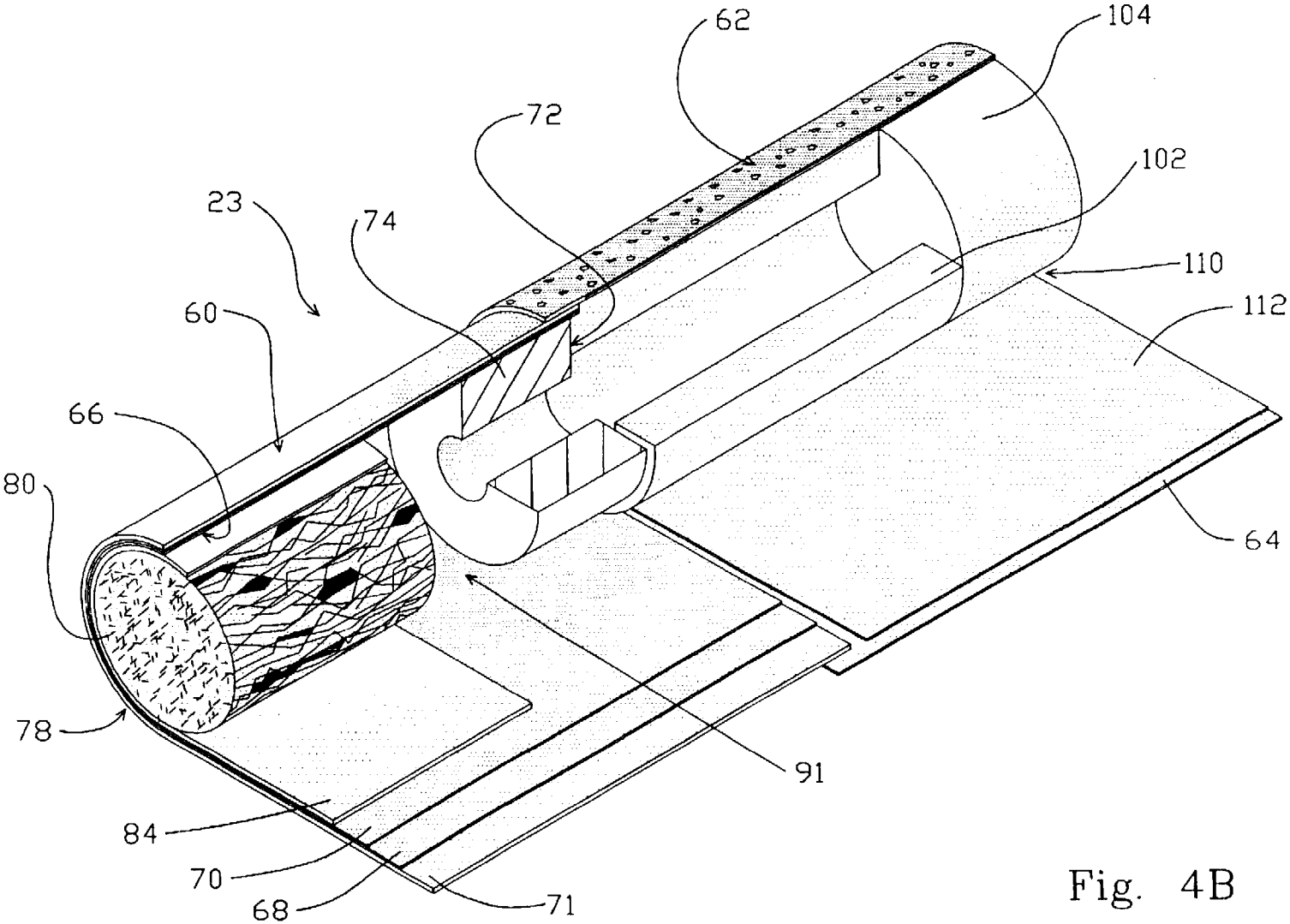
FIG. 4B is a detailed perspective view of the cigarette shown in FIG. 4A, with certain components of the cigarette being partially unravelled.

Referring now to FIGS. 4A and 4B, the cigarette 23 as constructed in accordance with the preferred embodiment of the present invention comprises a tobacco rod 60 and a filter tipping 62, which are joined together with tipping paper 64.

The partially-filled, filler cigarette 23 preferably has an essentially constant diameter along its length and, which like more traditional cigarettes, is preferably between approximately 7.5 mm and 8.5 mm in diameter so that the smoking system 21 provides a smoker a familiar "mouth feel". In the preferred embodiment, the cigarette 23 is 62 mm in overall length, thereby facilitating the use of conventional packaging machines in the packaging of the cigarettes 23. The combined length of the mouthpiece filter 104 and the free-flow filter 102 is preferably 30 mm. The tipping paper preferably extends approximately 6 mm over the tobacco rod 60. The total length of the tobacco rod 60 is preferably 32 mm. Other proportions, lengths and diameters may be selected instead of those recited above for the preferred embodiment.

The tobacco rod 60 of the cigarette 23 preferably includes a tobacco web 66 which has been folded into a tubular (cylindrical) form.

An overwrap 71 intimately enwraps the tobacco web 66 and is held together along a longitudinal seam as is common in construction of more traditional cigarettes. The overwrap 71 retains the tobacco web 66 in a wrapped condition about a free-flow filter 74 and a tobacco plug 80.

Preferably, the cigarette overwrap paper 71 is wrapped intimately about the tobacco web 66 so as to render external appearance and feel of a more traditional cigarette. It has been found that a better tasting smoke is achieved when the overwrap paper 71 is a standard type of cigarette paper, preferably a flax paper of approximately 20 to 50 CORESTA (defined as the amount of air, measured in cubic centimeters, that passes through one square centimeter of material, e.g., a paper sheet, in one minute at a pressure drop of 1.0 kilopascal) and more preferably of about 30 to 45 CORESTA, a basis weight of approximately 23 to 35 grams per meter squared ($g/m^2$) and more preferably about 23 to 30 $g/m^2$, and a filler loading (preferably calcium carbonate) of approximately 23 to 35% by weight and more preferably 28 to 33% by weight. The overwrap paper 71 preferably contains little or no citrate or other burn modifiers, with preferred levels of citrate ranging from 0 to approximately 2.6% by weight of the overwrap paper 71 and more preferably less than 1%.

The tobacco web 66 itself preferably comprises a base web 68 and a layer of tobacco flavor material 70 located along the inside surface of the base web 68. At the tipped end 72 of the tobacco rod 60, the tobacco web 66 together with the overwrap 71 are wrapped about the tubular free-flow filter plug 74. The free-flow filter 74 provides structural definition and support at the tipped end 72 of the tobacco rod 60 and permits aerosol to be withdrawn from the interior of the tobacco rod 60 with a minimum pressure drop. The free-flow filter 74 also acts as a flow constriction at the tipped end 72 of the tobacco rod 60, which is believed to help promote the formation of aerosol during a draw on the cigarette 23. The flee-flow filter is preferably at least 7 millimeters long to facilitate machine handling and is preferably annular, although other shapes and types of low efficiency filters are suitable, including cylindrical filter plugs.

At the free end 78 of the tobacco rod 60, the tobacco web 66 together with the overwrap 71 are wrapped about a cylindrical tobacco plug 80. Preferably, the tobacco plug 80 is constructed separately from the tobacco web 66 and comprises a relatively short column of cut filler tobacco that has been wrapped within and retained by a plug wrap 84.

Preferably the tobacco plug 80 is constructed on a conventional cigarette rod making machine wherein cut filler (preferably blended) is air formed into a continuous rod of tobacco on a traveling belt and enwrapped with a continuous ribbon of plug wrap 84 which is then glued along its longitudinal seam and heat sealed. However, in accordance with the preferred embodiment of the present invention, the plug wrap 84 is preferably constructed from a cellulosic web of little or no filler, sizing or burn additives (each at levels below 0.5% weight percent) and preferably little or no sizing. Preferably, the tobacco plug wrap 84 has a low basis weight of below 15 grams per meter squared and more preferably about 13 grams per meter squared. The tobacco plug wrap 84 preferably has a high permeability in the range of about 20,000 to 35,000 CORESTA and more preferably in the range of about 25,000 to 35,000 CORESTA, and is constructed preferably from soft wood fiber pulp, abaca-type cellulose or other long fibered pulp. Such papers are available from Papierfabrik Schoeller and Hoescht GMBH, Postfach 1155, D-76584, Gernsback, GERMANY; another paper suitable for use as the plug wrap 84 is the paper TW 2000 from DeMauduit of Euimperle FRANCE, with the addition of carboxy-methyl cellulose at a 2.5 weight percent level.

The tobacco rod making machine is operated so as to provide a tobacco rod density of approximately 0.17 to 0.30 grams per cubic centimeter (g/cc), but more preferably in a range of at least 0.20 to 0.30 g/cc and most preferably between about 0.24 to 0.28 g/cc. The elevated densities are preferred for the avoidance of loose ends at the free end 78 of the tobacco rod 60. However, it is to be understood that the lower rod densities will allow the tobacco column 82 to contribute a greater proportion of aerosol and flavor to the smoke. Accordingly, a balance must be struck between aerosol delivery (which favors a low rod density in the tobacco column 82) and the avoidance of loose-ends (which favors the elevated ranges of rod densities).

The tobacco column 84 preferably comprises cut filler of a blend of tobaccos typical of the industry, including blends comprising bright, burley and oriental tobaccos together with, optionally, reconstituted tobaccos and other blend components, including traditional cigarette flavors. However, in the preferred embodiment, the cut filler of the tobacco column 84 comprises a blend of bright, burly and oriental tobaccos at the ratio of approximately 45:30:25 for the U.S. market, without inclusion of reconstituted tobaccos or any after cut flavorings. Optionally, an expanded tobacco component might be included in the blend to adjust rod density, and flavors may be added.

The continuous tobacco rod formed as described above is sliced in accordance with a predetermined plug length for the tobacco plug 80. This length is preferably at least 7 mm in order to facilitate machine handling. However, the length may vary from about 7 mm to 25 mm or more depending on preferences in cigarette design which will become apparent in the description which follows, with particular reference to FIGS. 4A and 4B.

As a general matter, the length 86 of the tobacco plug 80 is preferably set relative to the total length 88 of the tobacco rod 60 such that a void 90 is defined along the tobacco rod 60 between the free-flow filter 74 and the tobacco plug 80. The void 90 corresponds to an unfilled portion of the tobacco rod 60 and is in immediate fluid communication with the tipping 62 through the free flow filter 74 of the tobacco rod 60.

Referring particularly to FIG. 4A, the length 86 of the tobacco plug 80 and its relative position along the tobacco rod 60 is also selected in relation to features of the heater elements 37. When a cigarette is properly positioned against the stop 182 of the heater fixture 39, a portion 92 of each heater element 37 will contact the tobacco rod 60 along a region of the tobacco rod 60. This region of contact is referred to as a heater footprint 94. The heater footprint 94 (as shown with a double arrow in FIG. 4A) is not part of the cigarette structure itself, but instead is a representation of that region of the tobacco rod 60 where the heater element 37 would be expected to reach operative heating temperatures during smoking of the cigarette 23. Because the heating elements 37 are a fixed distance 96 from the stop 182 of the heater fixture 39, the heater foot print 94 consistently locates along the tobacco rod 60 at the same predetermined distance 96 from the free end 78 of the tobacco rod 60 for every cigarette 23 that is fully inserted into the lighter 25.

Preferably, the length of the tobacco plug 80, the length of the heater footprint 94 and the distance between the heater footprint 94 and the stop 182 are selected such that the heater footprint 94 extends beyond the tobacco plug 80 and superposes a portion of the void 90 by a distance 98. The distance 98 by which the heater footprint 94 superposes the void 90 (the unfilled portion of the tobacco rod 60) is also referred to as the "heater-void overlap" 98. The distance by which the remainder of the heater footprint 94 superposes the tobacco plug 80 is referred to as the "heater-filler overlap" 99.

The tipping 62 preferably comprises a free-flow filter 102 located adjacent the tobacco rod 60 and a mouthpiece filter plug 104 at the distal end of the tipping 62 from the tobacco rod 60. Preferably the free-flow filter 102 is tubular and transmits air with very little pressure drop. Other low efficiency filters of standard configuration could be used instead, however. The inside diameter for the free flow filter 96 is preferably at or between 2 to 6 millimeters and is preferably greater than that of the free flow filter 74 of the tobacco rod 60.

The mouthpiece filter plug 104 closes off the free end of the tipping 62 for purposes of appearance and, if desired, to effect some filtration, although it is preferred that the mouthpiece filter plug 104 comprise a low efficiency filter of preferably about 15 to 25 percent efficiency.

The free-flow filter 102 and the mouthpiece filter plug 104 are preferably joined together as a combined plug 110 with a plug wrap 112. The plug wrap 112 is preferably a porous, low weight plug wrap as is conventionally available to those in the art of cigarette making. The combined plug 110 is attached to the tobacco rod 60 by the tipping paper 64 of specifications that are standard and conventionally used throughout the cigarette industry. The tipping paper 64 may be either cork, white or any other color as decorative preferences might suggest.

Preferably, a cigarette 23 constructed in accordance with the preferred embodiment has an overall length of approximately 62 mm, of which 30 mm comprises the combined plug 110 of the tipping 62. Accordingly, the tobacco rod 60 is 32 mm long. Preferably, the free-flow filter 74 of the tobacco rod 60 is at least 7 mm long and the void 91 between the free-flow filter 74 and the tobacco plug 80 is preferably at least 7 mm long. In the preferred embodiment, the heater foot print 94 is approximately 12 mm long and located such that it provides a 3 mm heater-void overlap 98, leaving 9 mm of the heater foot print 94 superposing the tobacco plug 80.

It is to be understood that the length of the void 91 and the length of the tobacco plug 80 may be adjusted to facilitate manufacturing and more importantly, to adjust the smoking characteristics of the cigarette 23, including adjustments in its taste, draw and delivery. The length of the void 91 and the amount of heater-filler overlap (and heater-void overlap) may also be manipulated to adjust the immediacy of response, to promote consistency in delivery (on a puff-to-puff basis as well as between cigarettes) and to control condensation of aerosol at or about the heaters.

In the preferred embodiment, the void 91 (the filler-free portion of the tobacco rod 60) extends approximately 7 mm to assure adequate clearance between the heater foot print 94 and the free-flow filter 74. In this way, margin is provided such that the heater foot print 94 does not heat the free-flow filter 74 during smoking. Other lengths are suitable, for instance, if manufacturing tolerances permit, the void 91 might be configured as short as approximately 4 mm or less, or in the other extreme, extended well beyond 7 mm so as establish an elongate filler-free portion along the tobacco rod 60. The preferred range of lengths for the filler-free portion (the void 91) is from approximately 4 mm to 18 mm and more preferably 5 to 12 mm.

The base web 68 physically separates the heating elements 37 from the tobacco flavor material, transfers heat generated by the heater elements 37 to the flavor material 70, and maintains physical cohesion of the tobacco rod during handling, insertion into the lighter 25 and removal of the cigarette after smoking.

In the description which follows, certain percentage levels and/or relative weights are set forth for the various components comprising the tobacco web 66. Unless otherwise expressed, or otherwise readily apparent to one of ordinary skill in the art to be to the contrary, recitations of weight percentage are on a dry weight basis, that is, the recited percentage levels and/or relative weights are adjusted for (do not include) moisture content.

The process for manufacturing the tobacco web 66 is preferably without the addition of carbon-fiber as will be described in paragraphs which follow. At the conclusion of the preferred manufacturing process, the base web 68 itself has a preferred total basis weight of approximately 35 to 45 $g/m^2$, more preferably approximately 40 $g/m^2$. At 40 $g/m^2$, the base web 68 preferably comprises approximately 28 $g/m^2$ tobacco fiber and approximately 12 $g/m^2$ cellulosic fiber such as from wood pulp or flax. The cellulosic fiber serves as a cellulosic strengthening agent in the composition of the base web 68. It is preferred to minimize the amount of cellulosic fiber in the base web for subjective reasons (to avoid establishing a papery note to the taste of the cigarette). Generally, the ratio of tobacco fiber to cellulosic fiber in the base web 68 on a dry weight basis should range from approximately 2:1 to 4:1. The preferred cellulosic material is an unbleached, kraft softwood cellulose, although most wood and flax pulps are workable.

An alternative strengthening agent for the base web 68 is cellulosic fiber from produced tobacco stem.

Although it is not preferred, alginate may be coated along one side of the base web 68 at a level of approximately 1 $g/m^2$. If alginate is applied, it is preferred to be applied on a side of base web 68 opposite of the side receiving the tobacco favor material 70.

The tobacco material 70 is preferably applied to the base web 68 at dry weight levels of at least twice and more preferably about three to four times that of the base web 68. In the preferred embodiment, the tobacco material has a basis weight of approximately 130 $g/m^2$ so that preferably the grand total weight of the tobacco web 66 is approximately 170 $g/m^2$. On a dry weight basis, the tobacco material 70 comprises a portion of ground tobacco and extracted solids at a ratio in the range of approximately 3.5 to 1 (3.5:1) to five to one (5:1) by weight, although this ratio may be varied in a range from approximately 3:1 to 9:1. In the preferred embodiment, the ratio is approximately 4.1.

Glycerine is added to the tobacco material 70 as a humectant and as an aerosol precursor at levels of about 10–14%, most preferably approximately 12% by dry weight of the tobacco material 70, but this add-on level may be varied anywhere from approximately 5% to as high as 20% or more by dry weight of the tobacco material 70. When glycerine is reduced to only about 5 to 7% dry weight of the composition, the tobacco web 66 may be somewhat stiffer and more resistive to collapse when rolled into a tubular form.

Pectin is also added to the tobacco material 70 at dry weight percentile levels ranging from about 0.5 to 2%, preferably about 1.4%. Pectin is added as a coating agent. In its absence, the tobacco material 70 may tend to drain into (penetrate) the base web 68 excessively during the coating operation, rendering a grainy surface texture on the coated side of the tobacco web 66. Too much pectin hampers penetration, and weakens the bond between the tobacco material 70 and the base web 68. At approximately 1%, the pectin promotes adequate penetration and bonding between the layers so that the base web 68 may withstand the rigors of automated cigarette making.

Most preferably, the tobacco material 70 on the base web 68 comprises approximately 16–20% by dry weight extracted tobacco solids, 66–71% by dry weight ground tobacco particles, 8–14% glycerine and approximately 1.4% pectin. For U.S. markets, the ground tobacco which is incorporated into the tobacco material 70 preferably comprises a blend of bright, burley and oriental tobaccos wherein almost half of the blend is bright tobacco, approximately ⅓ is burley and the remainder is oriental. The composition and relative amounts of the blend components may be advantageously adjusted to meet consumer preferences in the U.S. or other markets.

Figure 5A:
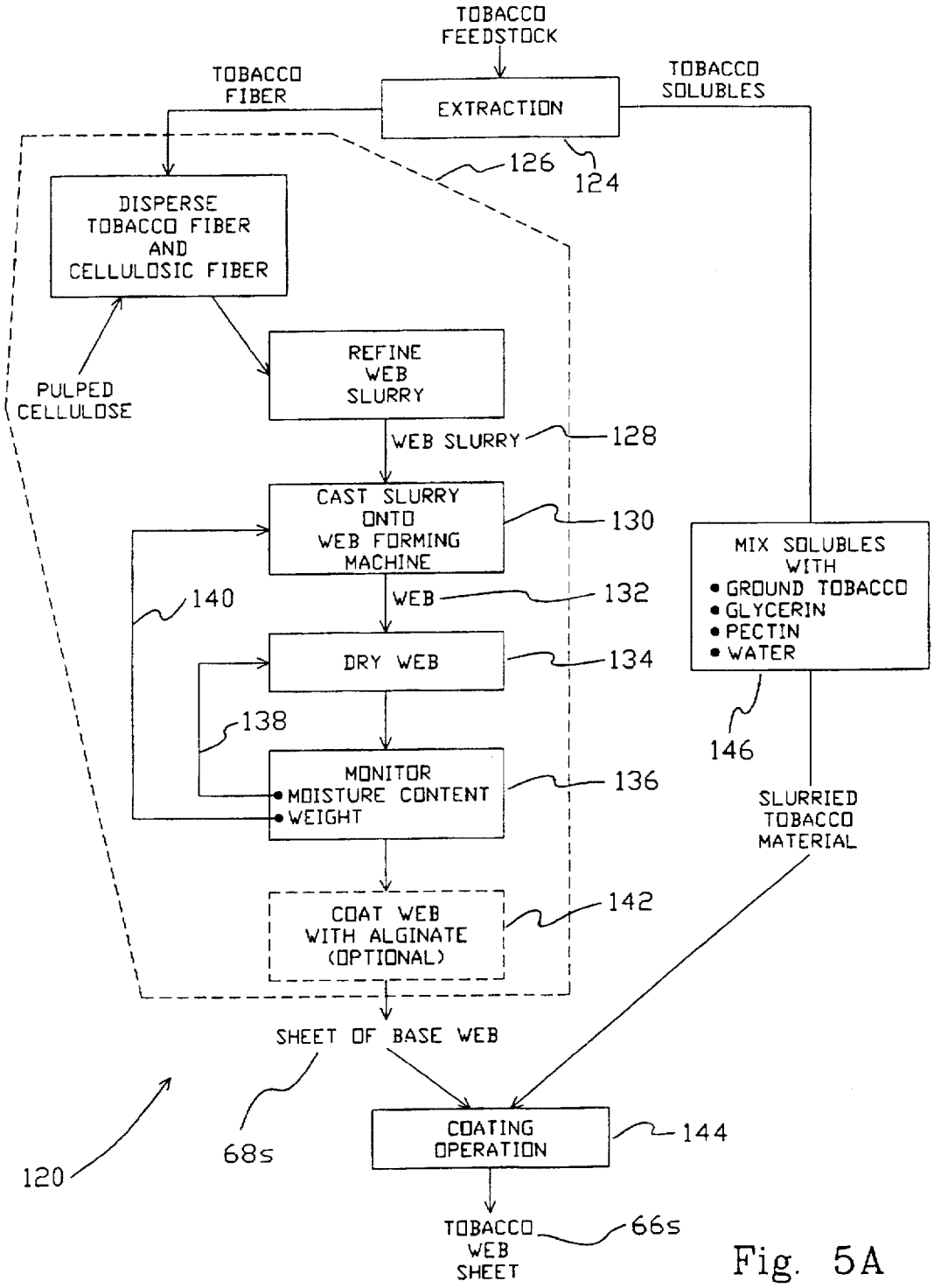
FIGS. 5A and 5B are flow diagrams of steps in a preferred process of making bobbins of the tobacco web of the cigarette shown in FIGS. 4A and 4B, wherein FIG. 5A show the steps of converting tobacco feedstock into a sheet of tobacco web.
Figure 5B:
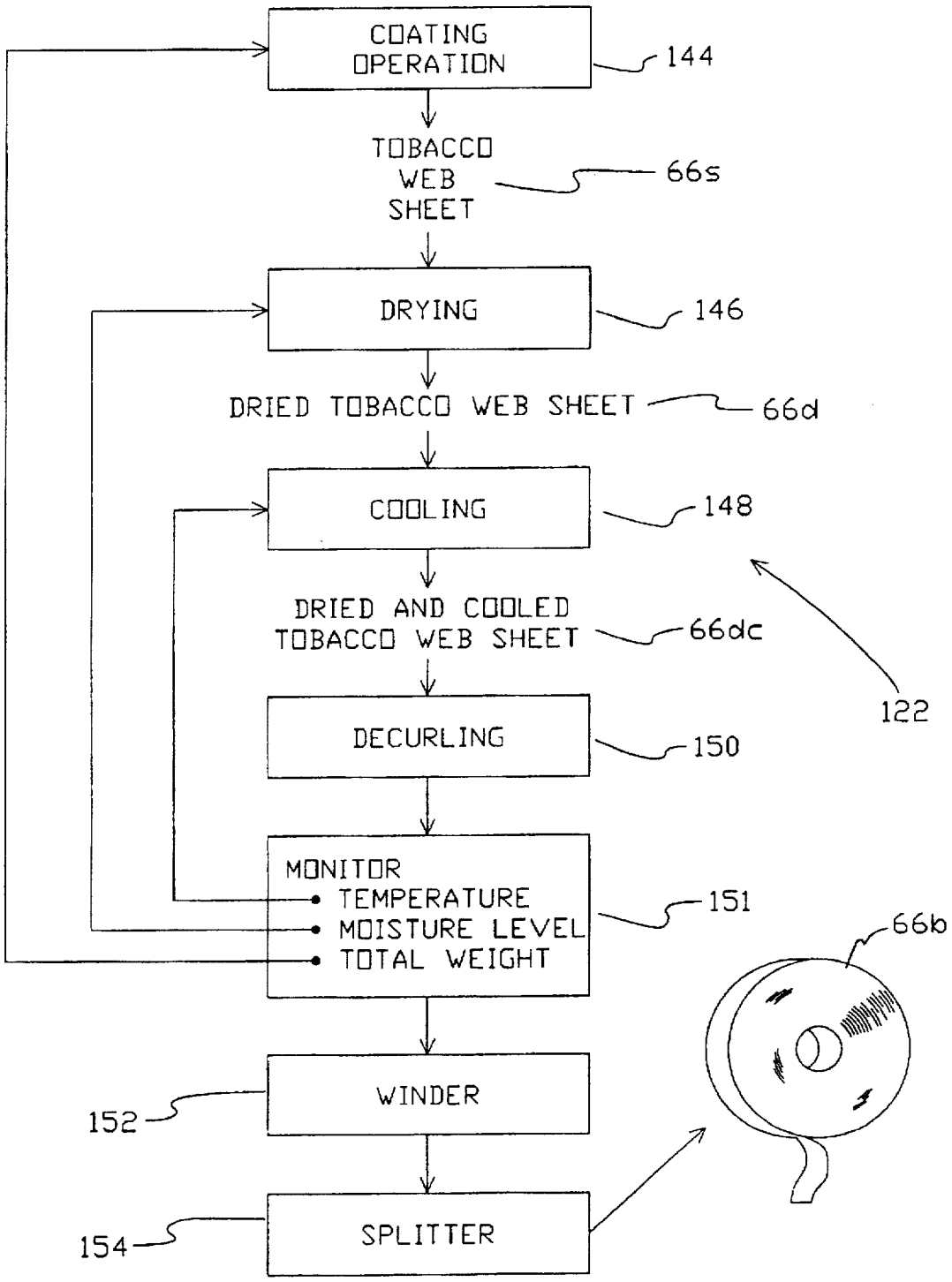

Referring to FIGS. 5A and 5B, the preferred method of manufacturing a stock of tobacco web 66 in a form suitable for the automated manufacture of the cigarettes 23 comprises a first series of steps 120 (shown in FIG. 5A) for the conversion of tobacco feedstock, preferably tobacco strip, into a continuous sheet of the tobacco web 66*s* and a second series of steps 122 (shown in FIG. 5B) of converting the continuous sheet of tobacco web 66*s* into one or more wound bobbins 66*b* of tobacco web that are in condition for use in the automated manufacture of the cigarettes 23.

Referring specifically to FIG. 5A, the process 120 of converting tobacco feedstock into a continuous sheet of tobacco web sheet 66*s* begins with subjecting tobacco feedstock to an extraction step 124 (preferably, with water) to separate tobacco fiber from tobacco solubles of the original feedstock. The tobacco feedstock preferably comprises tobacco strip, but other forms of tobacco and/or tobacco laminas are suitable for use in this process. Preferably the tobacco strip comprises a blend of bright and burley tobaccos, and may optionally include oriental or other varieties.

The tobacco fiber collected from the extraction process 124 is itself subjected to a paper-making type process 126 to form a continuous sheet 68*s* of the base web.

In the process 126, the tobacco fiber from the extraction step 124 is dispersed in water with the addition of a predetermined amount of cellulosic fiber which serves as a strengthening agent in the composition of the base web 68. Preferably, the cellulosic fiber comprises pulped cellulose from wood, flax and/or tobacco stem. Once combined, the mixed dispersion of tobacco fiber and cellulosic fiber is refined so as to form a web slurry 128 suitable for casting in the casting step 130, wherein the web slurry 128 is directed to a casting box arrangement of a web forming machine and cast upon a fourdrinier wire or on an endless steel belt, preferably the former.

It is more expedient to refine the dispersed mixture of tobacco fiber and the strengthening agent after mixing the two components together. They may instead be refined separately and then combined.

After the casting step 130, the resultant web 132 is then directed through one or more driers at a drying step 134, which step preferably comprises passing the web over a Yankee drier and one or more can driers, although a host of alternative arrangements and devices are known in the pertinent art and available for executing the drying step 134. At the conclusion of the web drying step 134, a monitoring step 136 is executed to measure the moisture content and weight of the dried web. The output 138 regarding measurement of moisture content is used to adjust the drying operation 134 to achieve and maintain the desired final moisture level in the sheet of base web 68*s* for purposes of the subsequent coating operation 144. The sheet of base web 68*s* is preferably at or about 15% moisture by weight at the coating operation 144.

Referring back to the monitoring step 136, the output 140 regarding the weight of the sheet of base web 68*s* is used to adjust operation of the casting step 130 so as to achieve the preferred basis weight in the base web 68 as previously described. Such adjustments include changes in the rate at which the web slurry 128 is introduced into the casting box of the web forming machine in the casting step 130.

The web forming step 126 may optionally further comprise a coating step 142 which coats one side of the base web 68*s* with alginate at levels previously described along one side of the base web 68*s* opposite of the side that receives the tobacco flavor material 70. However, it is the preferred practice to proceed without the application of alginate.

At the conclusion of the web forming process 126, the base web is in the form of a continuous sheet 68*s* that is conducive to undergoing the coating operation 144. In the alternative it may be collected for subsequent coating operations off-line. It is preferable, however to proceed immediately into the coating operation 144 upon the formation of the sheet of base web 68*s*.

Preferably, the base web 68*s* enters the coating operation 144 at a moisture content of approximately 12 to 17%, more preferably 14.5 to 15.5% moisture.

Referring back to the extraction step 124, the tobacco solubles leave the extraction step 124 in the form of a dilute solution comprising approximately 5 to 10 percent dissolved tobacco constituents (solubles), more preferably 7 to 8 percent dissolved tobacco constituents. Preferably, the dilute solution is not subjected to any evaporative treatment, so as to minimize the application of heat to the solution. The application of heat can have an impact on the flavor contributed by the tobacco solubles when smoked as part of the cigarette 23.

These solubles (also known as "extracted liquor") from the extraction step 124 are mixed at a mixing step 146 with additional, finely ground tobacco, glycerine and pectin, together with water, all in relative amounts that ultimately render the final proportional contents as previously described for the dried condition of the tobacco material 70. In connection with the mixing step 146, water is added (or withheld) in amounts sufficient to render at the conclusion of the mixing step 124 a dispersion of approximately 20 to 35 percent solids content, more preferably approximately 24 to 26 percent solids content. The ground tobacco particles of the mixture are preferably in the range of 60 to 400 mesh, wherein the term "mesh" refers to a 95% passage rate of tobacco particles through a mesh having the given number of openings per square inch. More preferably, the additional ground tobacco particles are in the range of approximately 100 to 200 mesh and most preferably approximately 120 mesh.

If the mesh size of the ground tobacco particles is established above 120 mesh, more specifically at or about 180 to 220 mesh, the solids content of the slurried tobacco material at the conclusion of the mixing step 146 may be elevated, such as to levels of approximately 28 to 31%.

Upon conclusion of the mixing step 146, the resultant slurried tobacco material is directed immediately into the coating operation 144, although the coating operation may be electively performed at some subsequent time on an off-line basis. At the coating operation 144, the slurried tobacco material should have a solids content of approximately 22 to 27% by weight, more preferably at or about 24 to 25%.

At the coating step 144, the slurried tobacco material has a target weight percent of tobacco solubles of 4 to 8 percent, more preferably 5.5 to 6.5 weight percent of tobacco solubles. Preferably, the slurried tobacco material enters the coating operation 144 at a temperature in the range of approximately 70° to 130° F., more preferable at or about 90° F. plus or minus 5° F.

The coating step 128 is preferably performed with a standard reverse-roll coater located after a Yankee dryer beyond the endless belt or fourdrinier wire. The coating step may be performed with other suitable coating devices that are known and available to those of ordinary skill in the art of web forming operations. The tobacco material 70 may instead be cast or extruded onto the base web 68. Alternatively, the application step 128 may be executed off-line separate from the production of the sheet of base web 68*s*. During or after the coating step 128, flavors that are conventional in the cigarette industry are added if desired.

At the conclusion of the coating operation 144, a continuous sheet of tobacco web 66*s* is produced.

Referring now to FIG. 5B, the process now proceeds through the steps 122 of converting the sheet of tobacco web 66*s* into a wound bobbin 66*b* of tobacco web which is suitable for the automated production of cigarettes 23. Preferably, the conversion steps 122 are executed on-line with the production of the continuous sheet of tobacco web 66*s*. During the execution of the conversion steps 122, the operator should avoid conditions which create breaks, tears or other imperfections in the tobacco web sheet 66*s* so that a continuous winding of tobacco web is obtained in the bobbin 66*b* with few or no splices. Additionally, the sheet of tobacco web 66*s* is to be conditioned such that at the conclusion of the converting steps 122 the tobacco web will not bind upon itself and may be rapidly wound and unwound from the bobbin 66*b* without breakage.

The conversion steps 122 initiate with a drying step 146, wherein preferably the sheet of tobacco web 66*s* is fed continuously through a gas-fired, hot-air impingement dryer such as the type obtainable from Airtech Systems Corp. of Stroughton, Me. or with a steam heated, hot air dryer. Other driers that are known in the art of web forming may be employed instead. The drying step 146 should be executed with minimal application of heat but in amounts sufficient to dry the tobacco web 68*s* from its initial condition (approximately 15% moisture content in the base web and approximately a 75% moisture level in the coating itself) to about 8.5 to 12% moisture content overall at the conclusion of the drying step 146. More preferably, the dried tobacco web sheet 66*d* is in the range of approximately 10 to 11% moisture content. This final moisture content is preferred for several reasons: to facilitate slitter operations at a later stage in the conversion process 122; to set a moisture level which approximates where the material would equilibrate when stored and/or sent to a manufacturing facility; and to establish a moisture level which avoids tackiness and binding of the base web material upon itself in the bobbin 66*b*.

Subsequent to the drying step 126, the dried tobacco web sheet 66*d* is cooled to an ambient temperature, preferably that of its likely place of storage and/or associated manufacturing facility, usually in the range of 65° to 80° F. This cooling step 148 not only facilitates equilibration of the tobacco web 66 to operational environments, but also avoids the risk of heat being retained within a bobbin 66*b* which might otherwise initiate a self-heating process. If left unchecked, self-heating could lead to extreme temperatures and degradation of the subjective character of the tobacco web 66. Preferably, the cooling step is performed with a chilled-water cooled, air impingement cooler available from Airtech Systems Corp. of Stroughton, Me., although a host of alternate cooling systems are known to those of ordinary skill in the art of web forming.

After the web drying and cooling steps 146 and 148, the dried and cooled tobacco web sheet 66*dc* is passed though a decurler apparatus, such as those offered by Thermo Electron Web Systems, Inc. of Auburn, Me. or some other suitable web decurler device as would be readily known and available to one of ordinary skill in the pertinent art of web forming. At the conclusion of the decurling step 150, the tobacco web 66 is substantially free of thermally induced warping along its edges and is in condition for a subsequent winding and slitting steps 152 and 154. However, prior to the execution of those steps, it is preferable to monitor temperature, moisture level and total weight of the tobacco web sheet 66*s* as it leaves the decurling step 150 so as to provide feedback and control of the process to assure that the tobacco web sheet 66*s* is in condition for winding and slitting and will result in the desired target values of temperature and moisture, total weight for the bobbins 66*b*.

In particular, in monitoring the tobacco web sheet 66, the reading of its total weight are used to adjust the coating operation 144, such as in the feed rate of slurried tobacco material into the reverse-roll coater or the gap at the nip of the coater. Readings of the moisture level at the monitoring step 151 are used to control drying operations so as to achieve the target moisture levels in the sheet as described previously. Likewise, the cooling step 148 is controlled responsively to readings of the temperature of the sheet of tobacco web 66 at the monitoring step 151.

Thereafter, the tobacco web sheet 66 is wound at a winding step 152, which is performed with web winding machines readily known and available to one of ordinary skill in the art of web processing. Subsequent thereto, the wound tobacco web sheet 68*s* is slit into individual bobbins 66*b*, wherein the cut-width for each bobbin is respective of the desired circumference of the cigarette 23.

At the conclusion of the conversion steps 122, the bobbin 66*b* is in condition for automated manufacturing processes of the cigarettes 23, such as in the combining operations disclosed with reference to FIG. 6 of commonly assigned, U.S. Pat. No. 5,505,214, which patent is hereby incorporated by reference in its entirety.

The glycerin in the tobacco material 70 serves as an aerosol precursor and facilitates formation of a visible aerosol during smoking of the cigarette 23. Additionally, as the glycerin is released in the atmosphere, it condenses and provides an appearance typically expected of cigarette smoke. Other humectants, suitable for use in the tobacco industry may be used in its place.

Optionally, after the casting step 123, alginate may be coated along a side of the web 68 before, during or after the coating step 126. The alginate coating provides additional strength and film formation along one side of the base web 68. However, the base web 68 has sufficient strength without alginate, and it is the preferred practice to construct the base web 68 without it.

The present invention may be practiced with other types of base webs 68 (carriers), including the carbon-fiber mats or the metallic or screen mats described in commonly assigned U.S. Pat. Nos. 5,505,214; 5,369,723; 5,388,594, all of which are incorporated herein by reference in their entireties.

With regard to carbon-fiber mats as disclosed in commonly assigned U.S. Pat. No. 5,388,594, whose continuation is co-pending herewith as Ser. No. 08/380,718, filed Jan. 30, 1995, a preferred composition of such mats comprises a base web 68 comprising tobacco fiber in the range of 20–30 g/m$^2$, more preferably approximately 24 to 28 g/m$^2$, most preferably 26 g/m$^2$; carbon fiber in the range of 2–9 g/m$^2$, more preferably 2 to 4 g/m$^2$, and most preferably approximately 3 g/m$^2$; and pectin in the range of approximately 0.5 to 1.5 g/m$^2$, and most preferably approximately 1 g/m$^2$ pectin. Preferably, these constituents are balanced so as to establish a base web 68 having a total basis weight of approximately 30 g/m$^2$. It is also preferred to use carbon fiber of ¼ inch strand length to facilitate its dispersion during the slurry forming portion of the process. Initiation of dispersion of the carbon fiber feedstock is faciliated when procedures are used such as those disclosed in U.S. Pat. Nos. 4,007,083 and 4,234,379.

In the alternate embodiment of the tobacco base web 66 (i.e., the carbon fiber mat), the total finished dry sheet weight is preferably about 160 g/m$^2$, of which 30 g/m$^2$ comprises the base web 68 and 130 g/m$^2$ comprises the tobacco material 70. In contrast, the more preferred embodiment of the tobacco base web 66, which does not include carbon-fiber, has a dried sheet weight of approximately 170 g/m$^2$, of which 40 g/m$^2$ comprises the base web 68 and 130 g/m$^2$ comprises the tobacco material 70.

Whichever type of base web 68 (or carrier) is used, the tobacco material 70 is preferably disposed on the inner surface of the base web 68 and liberates a tobacco flavored aerosol (response) when heated. Such materials may also include continuous sheets, foams, gels, dried slurries or dried spray-deposited slurries of tobacco material.

Referring to FIG. 3 and in conjunction with the teachings incorporated by reference from commonly assigned U.S. Pat. No. 5,388,594 (PM 1697), when a cigarette 23 of the preferred embodiment is inserted into receptacle 27, it is guided into the heating fixture 39 until the free end 78 of the cigarette 23 abuts a stop 182 fixedly arranged at the base of the heater fixture 39. Once the cigarette is in place, smoking may commence, whereupon any puffing action on the cigarette by a smoker is detected by the puff sensor 45, which in cooperation with the control circuit 41, causes electric current to be delivered to a preselected one of the heaters 37. Power is delivered via an electrical circuit which includes leads 183 at one end of each heater 37, a common ring 184 at the opposite end of each heater 37 and a common lead 186 extending from the common ring 184 back to the proximity of the leads 183. As each heater 37 is activated, thermal energy is transferred through the overwrap 71 and the tobacco web 68 in sufficient amount to cause the tobacco flavor material 70 of the tobacco web 66 to release a tobacco aerosol within the confines of the tobacco rod 60, which is drawn from the cigarette 23 responsively to the puffing action of the smoker on the tipped end of the cigarette 23.

A smoker's draw on a cigarette typically endures approximately 1.5 to 2.0 seconds, while FTC cigarette testing procedures assume a 2.0 second puff duration.

Where the heater footprint 94 overlaps the void 91, aerosol is released directly from the heated tobacco flavor material 70 into the void 91 whereupon it is withdrawn into and through the tipping 62 with very little pressure drop. On the other hand, where the heater footprint 94 overlaps the tobacco plug 80 (the heater/filler overlap 99), proximal portions of the tobacco plug 80 will become heated along with proximal portions of the tobacco web 66. Accordingly, the blended tobaccos of the tobacco plug 80 contribute their own fraction of the total aerosol so as to contribute their taste and other subjective attributes. The aerosol released from the tobacco plug 80 at or about the heater/filler overlap 99 undergoes some filtration and pressure drop as it is drawn through the tobacco plug 80 and into the void 91.

The aerosol produced from heating of the tobacco plug 80 has a character and taste that can be altered by the blend of tobaccos as well as by adjustments in how much of the heater footprint 94 overlaps the tobacco plug 80. The component of aerosol that is produced in the vicinity of the void 91 is released more instantaneously from the cigarette, because there is less thermal inertia at the void 91 and because the thermally vaporized tobacco substance at the void 91 is not subject to the pressure drop of the tobacco plug 80 and is instead more immediately communicated to the tipping 62 through the free-flow filter 74. It however has a character different from that released from the tobacco plug 80, because it is released predominately from the tobacco flavor material 70 on the base web 68. As will be explained in greater detail below, it has been found that for smoker satisfaction, the aerosol delivered from a cigarette 23 preferably includes both components of aerosol to assure immediate delivery to the smoker and to include the flavor notes attributable to blended cut filler tobaccos. As will also become apparent in the teachings which follow, the presence of the void 91 (and its immediacy of initial delivery) assures a consistent puff-to-puff smoking of the cigarette 23 and promotes consistency between cigarettes. This relationship bears out in the comparative puff-to-puff attributes of a partially filled cigarette 23 constructed in accordance with the preferred embodiment (having a plug of cut filler 80 and a void 91), in comparison with cigarettes 23' of a first alternate design (FIG. 6A) having no cut filler within its rolled tobacco web, and a second alternate design (FIG. 7A) having a rolled tobacco web entirely filled with cut filler. In the depictions of these alternate designs, it is to be understood that the tobacco web 66' and 66" comprise a base web 68 and layer of tobacco material 70 as in the preferred embodiment. The tobacco rods 60' of these alternate designs also included on overwrap 71.

Figure 6A:
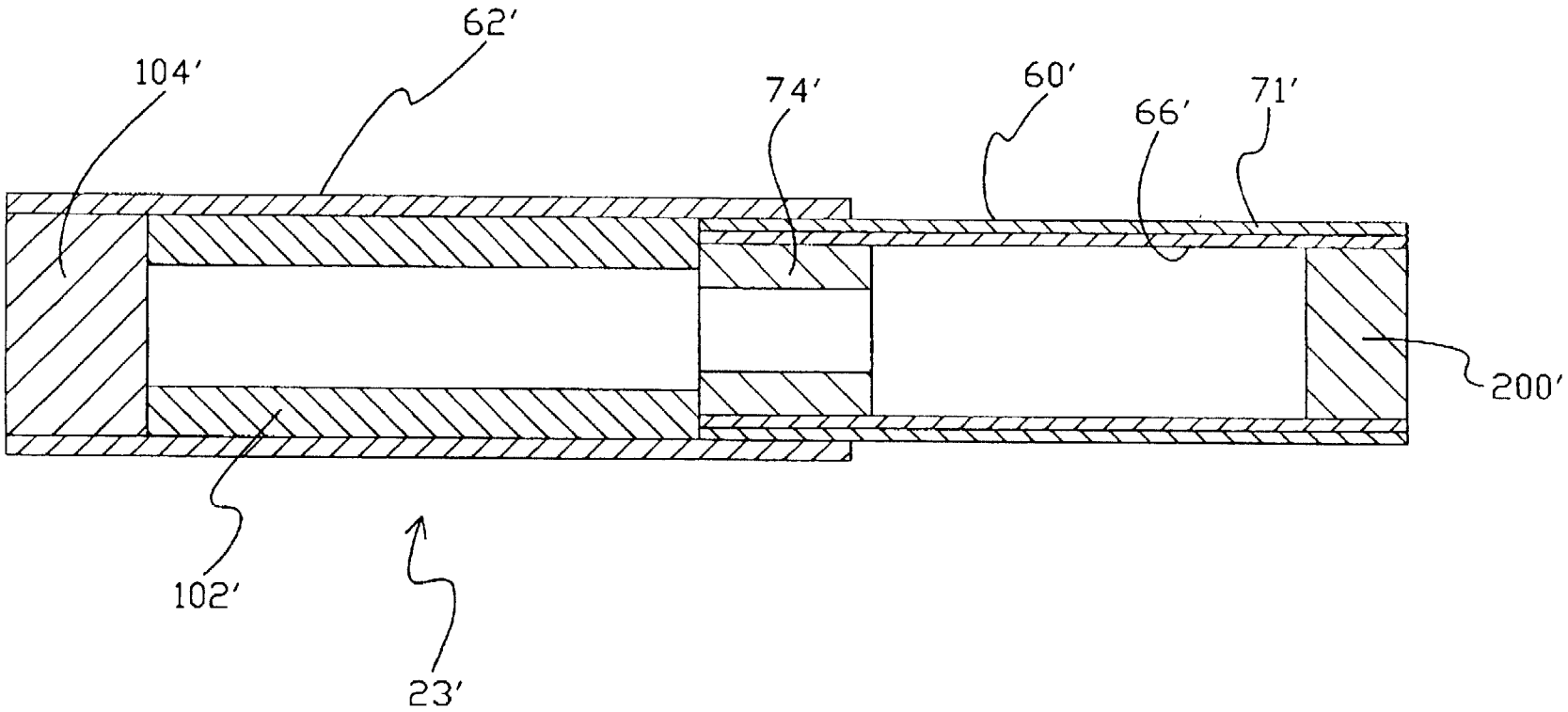
FIG. 6A is a cross-sectional side view of a cigarette constructed in accordance with a substantially hollow embodiment of the present invention.
Figure 6B:
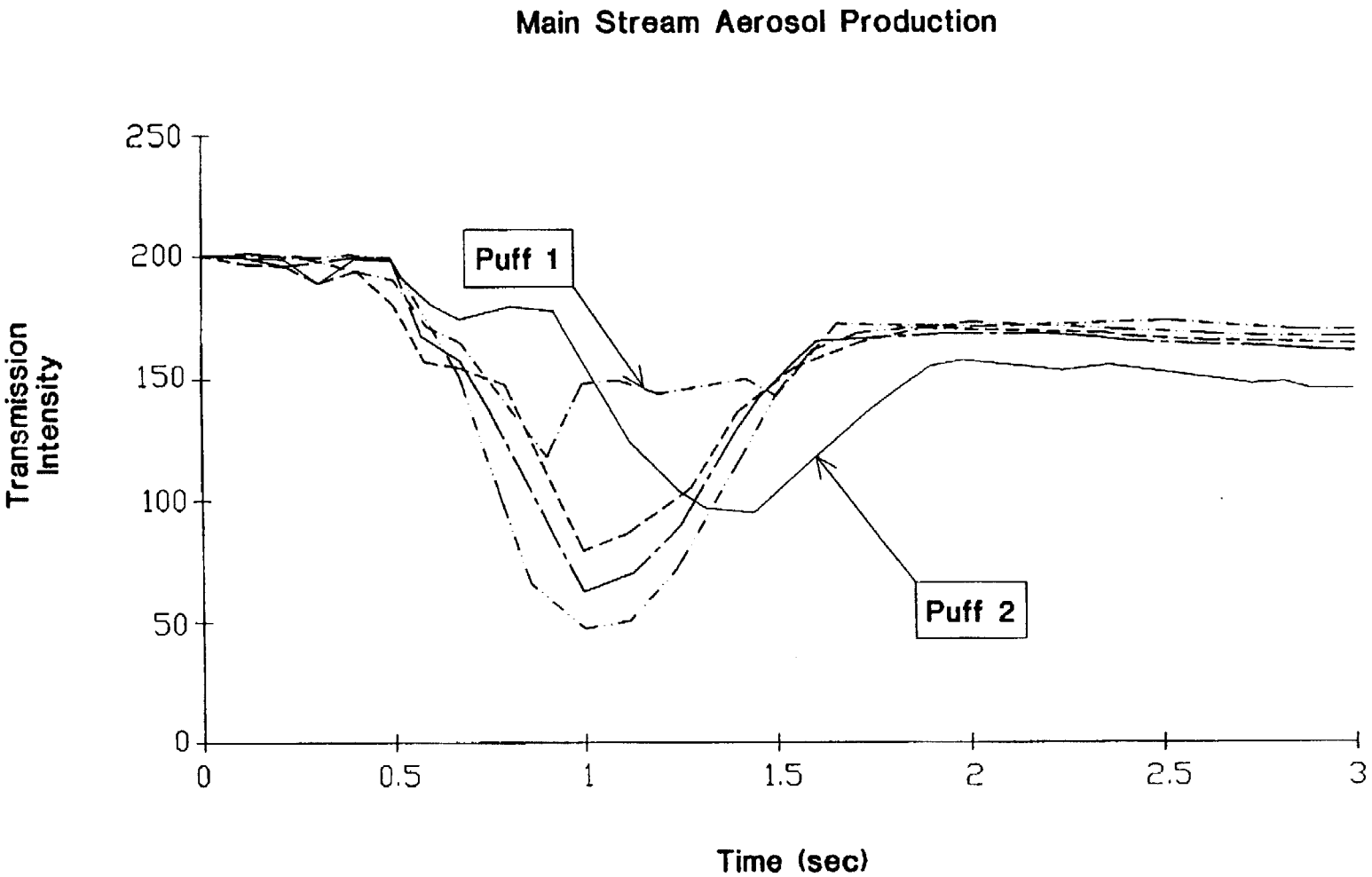
FIG. 6B is a graphical representation of aerosol production versus time during each puff as generated by a cigarette constructed in accordance with the substantially hollow embodiment of the present invention of FIG. 6A.
Figure 7A:
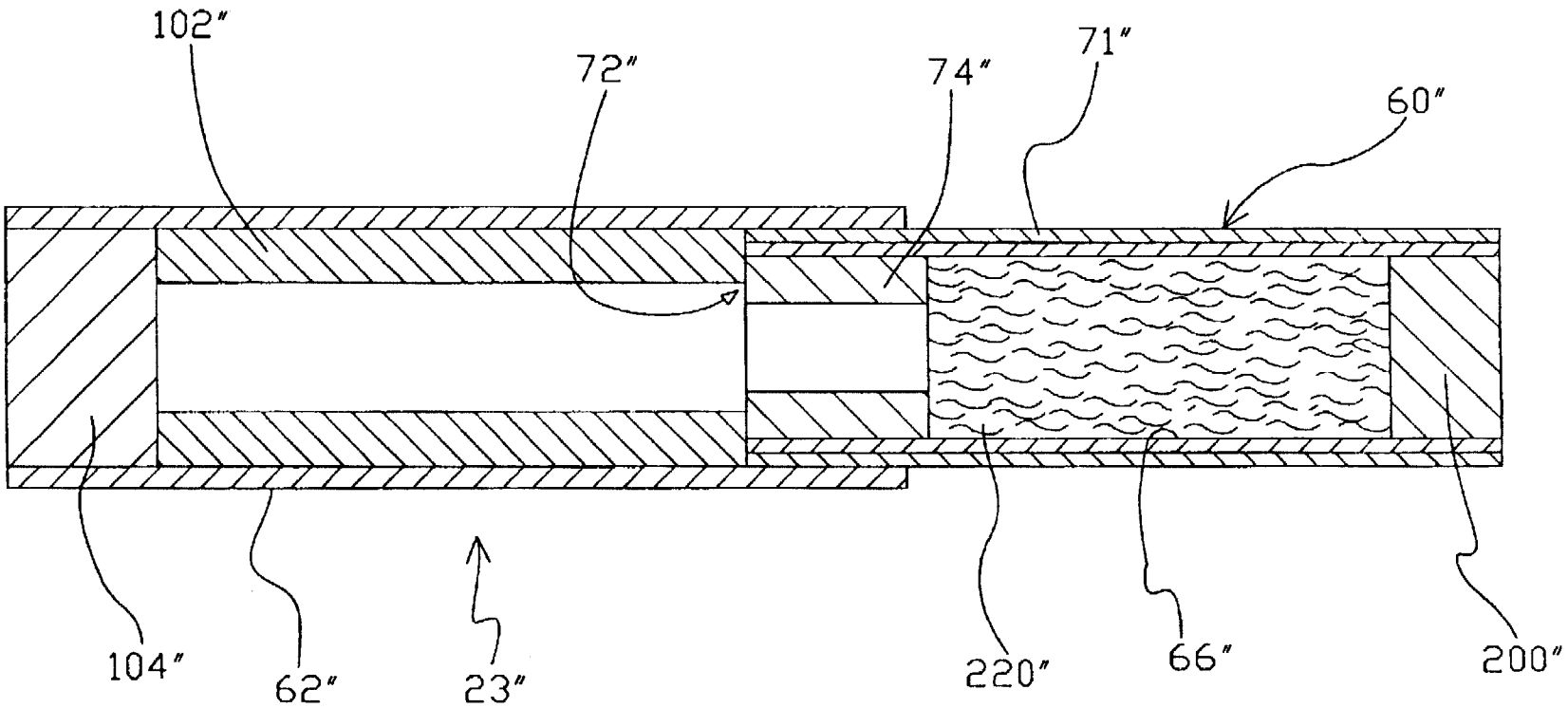
FIG. 7A is a cross-sectional side view of a cigarette constructed in accordance with a fully-filled embodiment of the present invention.
Figure 7B:
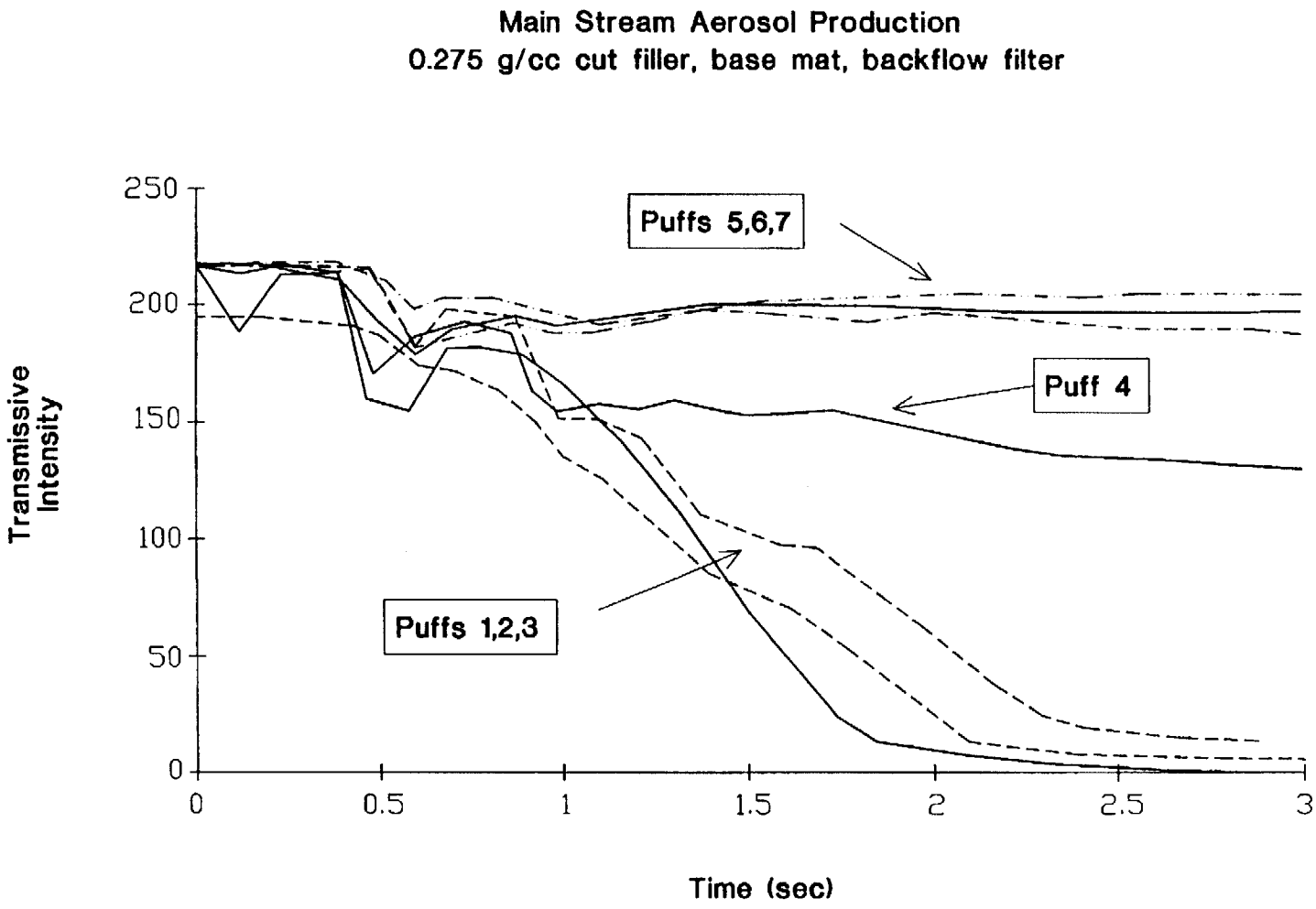
FIG. 7B is a graphical representation of aerosol production versus time during each puff as generated by a cigarette constructed in accordance with the fully-filled embodiment of FIG. 7A.

A serpentine type heater element at a 15 Joules energy setting was used to generate the comparative data as presented in FIGS. 6B and 7B with the cigarettes shown in FIGS. 6A and 7A, respectively.

In reference to FIG. 6A, a cigarette adapted for smoking in an electrical smoking system of the first alternate design comprises a tobacco rod 60' and a tipping 62', each which include components designated with prime numbers having correspondence with components of the preferred embodiment shown in FIG. 4A. However, the tobacco rod 60' of the cigarette 23' does not enclose any cut filler within its tobacco web 66' and the free end 78' of the tobacco rod 60' is provided with a back flow filter 200'. The base web 68' of the tobacco web 66' was the type including carbon fiber as previously described. The construction of cigarette 23' is also detailed in the commonly assigned U.S. Pat. No. 5,388,594, which is hereby incorporated by reference in its entirety. For purposes of the description which follows, reference will be made to this cigarette 23' as a filler-free cigarette 23'.

Figure 6C:
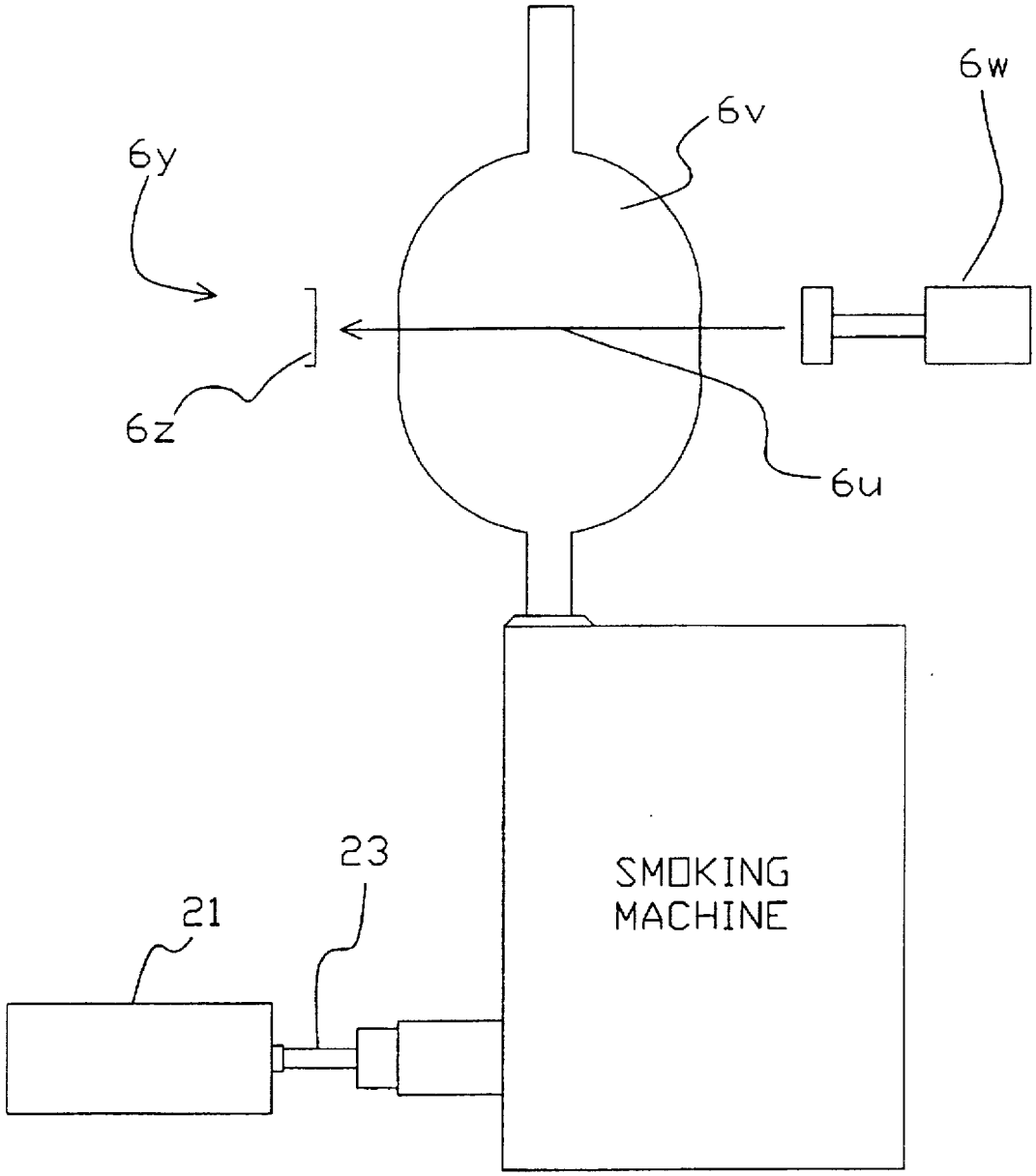
FIG. 6C is a layout of a smoke measuring device that was used to establish data that is represented in FIGS. 6B, 7B and 8.

Referring now to FIG. 6C, experiments were conducted using a smoking machine in cooperation with a smoking system 21. The output of the smoking machine was directed during each puff through a smoke measuring device **6*y* having a transparent chamber 6*v*, where a beam of light 6*u* from a source 6*w* passes through the transparent chamber 6*v* to a photo detector 6*z* at the opposite of side of the transparent chamber 6*v*. The output of the photo sensor 6*z* is processed to resolve the intensity of the light beam 6*u* as its strikes the sensor 6*z*. Any tobacco aerosol that passes through the chamber 6*v* will have a light scattering effect upon the beam of light 6*u*, such that any resultant change in detected light intensity at the photo detector 6*z* will be inversely indicative of total particulate matter (TPM) in the aerosol. In accordance with FTC cigarette testing practices, it is preferred that the smoking machine draws a standard two-second puff from the smoking system 21**.

The information graphically presented in FIG. 6B shows the intensity registered at the smoke measuring device relative to time as the smoking machine progressed through each of a succession of puffs on a filler-free cigarette 23'. The data indicates the following trends: that with a filler-free cigarette 23', the first and second puffs are inconsistent with the remaining three puffs, which latter three puffs are much more consistent with each other; and that aerosol is delivered well before lapse of the two-second time period for each puff. The filler free cigarette 23' is less consistent in delivery at the first several puffs and consistency prevails only in the latter puffs. The data related to the first puff is fairly consistent with the general observation that machine smoking of a filler-free cigarette 23' delivers less aerosol during the first puff unless remedial measures are implemented such as perforating the tobacco rod 60' or other measures as taught in U.S. Pat. No. 5,388,594.

Referring now to FIG. 7A, another design of an electrically operative cigarette 23" comprises a tobacco rod 60" and a tipping 62" having components and an arrangement similar to those of the preferred embodiment shown in FIG. 4A, with similar components being provided with double prime designations. However, the cigarette 23" of FIG. 7A includes a back flow filter 200" at the free end 78" and a column of cut filler 220" extending along the entire length of the tobacco rod 60" between the back flow filter 200" and the free-flow filter 74" of the tobacco rod 60". The tobacco column 220" of the cigarette 23" comprises the blend of burley, bright and oriental tobaccos at a rod density of 0.275 grams per cubic centimeter. The base web 68" of the tobacco web 66" is the type including carbon fiber as previously described. In the discussion which follows, the cigarette 23" will be referred to as a fully-filled, filler cigarette 23".

Referring now to FIG. 7B, the measurements in light intensity from the smoke measuring device 6y was correlated with the time lapse progression of each puff for a succession of puffs numbered one through seven on the fully-filled, filler cigarette 23". The data presented in FIG. 7B is representative of two recognizable trends in the performance of a cigarette constructed in accordance with the fully-filled, filler cigarette 23": that the first several puffs provide significant aerosol delivery, but yet delivery thereafter declines to such an extent that the latter three puffs provide substantially less delivery than the first several puffs (unless corrective measures are taken); and with the fully-filled, filler cigarette 23", aerosol delivery is delayed and the initial puffs (puffs one, two and three) do not achieve maximum delivery until after a substantial portion of a two-second period has elapsed.

During the first several puffs, the fully-filled cigarette 23" tends to deliver a greater total volume of aerosol than the filler-free cigarette 23'. A comparison of the data presented in FIGS. 7B and 6B substantiates this general observation in that the total areas above the first several puff-lines in FIG. 7B for the fully-filled, filler cigarette 23" are greater than the total areas above the first several puff-lines in FIG. 6B for the filler-free cigarette 23'. The area above each puff-line in FIGS. 7B and 6B is indicative of total delivery during that puff.

However, it is believed that the delay in delivery of the fully-filled, filler cigarette 23" induces a smoker to undertake a prolonged, more robust draw in reaction to his or her not obtaining an immediate flavor response from the cigarette 23". The more pronounced draw in turn can cause the heated portions of the overwrap 71" and the tobacco web 66" to become more fully consumed (oxidized) by the additional air drawn therethrough such that more significant breakage and perhaps localized collapse of the tobacco column 220" occurs during the first several puffs. Additionally, it is believed that once pyrolysis is initiated in the fully-filled cigarette, it tends to be more self-sustaining, because of the presence of a greater mass of combustable tobacco and/or because of its more compacted state. In any event, because air may be drawn more readily into the tobacco rod through the breached "burn" situses of the first several puffs, these localized breaches are believed to short circuit the desired air flow paths of subsequent puffs. Consequently, delivery declines during the latter puffs on the fully-filled, filler cigarette 23".

The data presented in FIG. 7B and the explanation above is consistent with a general observation that a fully-filled, filler cigarettes 23' or a traditional cigarette, when they are smoked with electrical lighters, tend to drop off in delivery as puffing thereon progresses.

With its delayed, yet more self-sustaining pyrolysis, the fully-filled cigarette 23' tends to generate a great amount of aerosol in the latter stages of the puff, and at times may continue to produce an amount of aerosol beyond the period of time that the smoker is actually drawing on the cigarette. The latter situation can result in the production of "post-puff" aerosol which may linger within the housing 33 of the lighter 25, particularly at or about the heater fixture 39. Some of such "post-puff" aerosol will problematically condense on the heater elements 33 or linger long enough to be drawn into the cigarette 23" during the next puff. Either consequence is inimical to the delivery of a pleasing and consistent taste.

Referring back to FIG. 6B, the puff lines of the filler-free cigarette 23' evidence that the delivery of aerosol maximizes (where the puff lines dip the most) well before the two (2) second duration of a standardized puff has elapsed, and delivery is minimal at the latter stages of the puff, so that the production of "post puff" aerosol is not such a problem with the filler-free cigarette 23'. However as noted previously, the filler-free cigarette 23' delivers less total volume of aerosol than the fully-filled, filler cigarette 23", it suffers inconsistency at times in delivery during the first several puffs and it lacks the subjective attributes and flexibilities that would otherwise be enjoyed if blended (or even unblended) cut filler were included.

Figure 8:
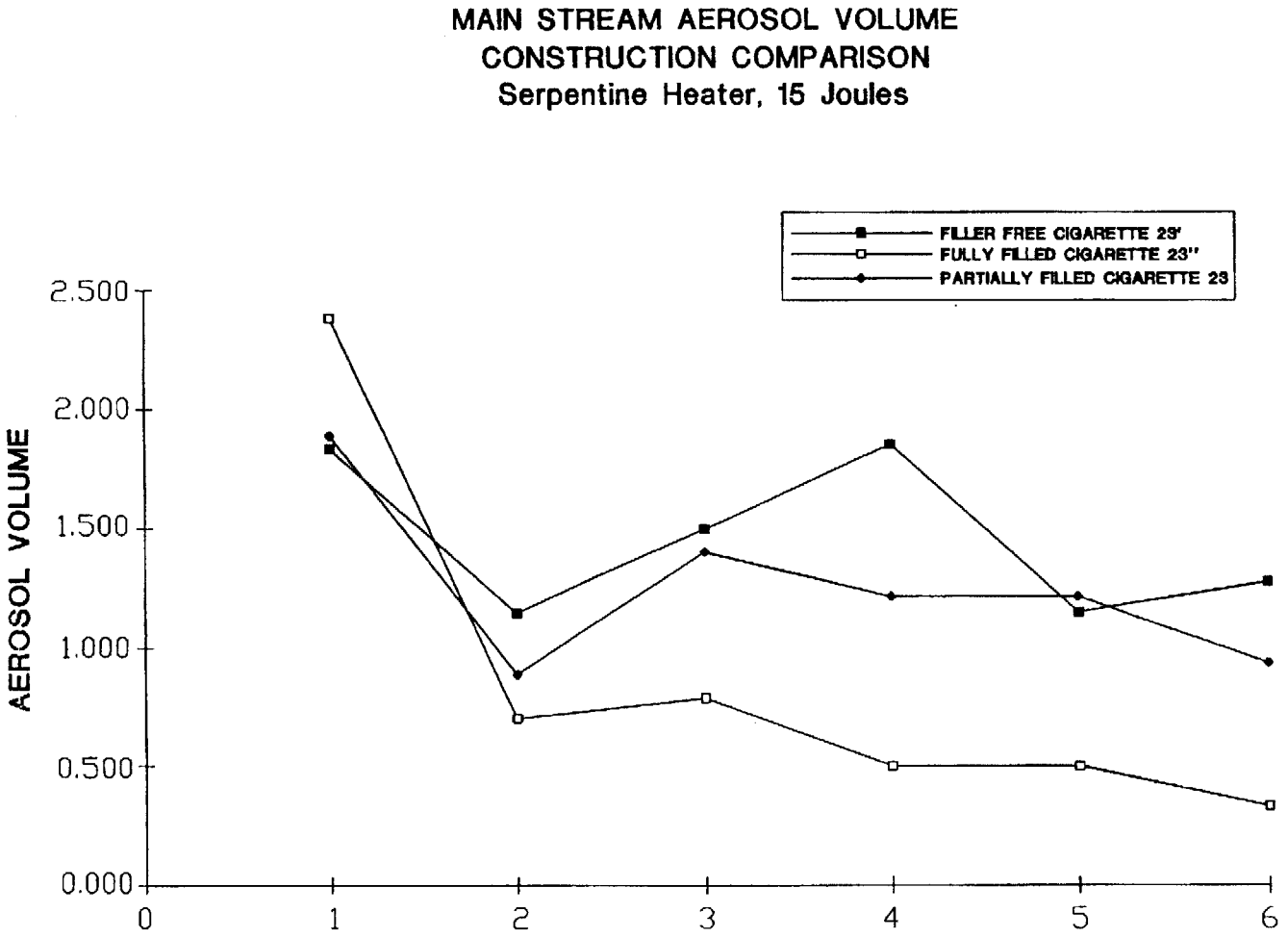
FIG. 8 is a graphical comparison of aerosol volume at each sequential puff as delivered by each cigarette of those described in reference to FIGS. 4A, 6A and 7A.

FIG. 8 is a presentation of data from comparative smoking on smoking machines using a smoke measuring device 6y as described above for cigarettes constructed in accordance with the filler-free cigarette 23'; the fully-filled, filler cigarette 23"; and the partially-filled, filler cigarette 23 constructed in accordance with teachings of the preferred embodiment (as shown in FIG. 4A) of the present invention. Carbon-fiber mat was used as the base web in all these cigarettes. As a discussion of the data of FIG. 8 will reveal, the partially-filled, filler cigarette 23 of the present invention provides more consistent delivery throughout a smoke. It avoids the drop in delivery that occurs in the latter puffs of the fully-filled, filler cigarette 23" and is more consistent in delivery than the filler-free cigarette 23' during the first several puffs.

The partially-filled, filler cigarette 23 that was tested to collect data used in FIG. 8 was half-filled with cut filler such that the heater overlap over the void in the cigarette design was relatively large, approximately 6 mm. The heater elements 37 used for generating the data presented in FIG. 8 was a serpentine type at 15 Joules energy per heating cycle.

Referring to FIG. 8 in particular, the data presented therein is the amount of aerosol (in milligrams) generated during the first two seconds of each puff in a progression of puffs during the smoking of each particular type of cigarette. In relation to the data presented in FIGS. 6B and 7B, an amount of aerosol indicated in FIG. 8 would analytically correspond to an integration of (the area defined above) each puff-line from 0 to 2 seconds in FIGS. 6B and 7B.

The presentation of data in FIG. 8 clearly illustrates the drop in delivery that is experienced with a fully-filled, filler cigarette 23" as one progresses from the first puff to subsequent puffs. In contrast, the filler-free cigarette did not suffer the drop in delivery as with the fully-filled, filler cigarette 23".

The presentation of data in FIG. 8 also clearly illustrates that the partially-filled, filler cigarette 23 provides consistency in delivery comparable to that of the filler-free cigarette 23' throughout the six puffs. Furthermore, it does so with a contribution of cut-filler to its taste and subjective impact.

Referring to Table II, data was collected indicative of how changes in the amount of heater overlap at the void in a cigarette constructed in accordance with cigarette 23 can affect delivery. The data presented in Table II was produced from machine smoking of partially filled cigarettes having a 32 mm tobacco rod, a 7 mm free-flow filter at the tipped end of the tobacco rod and a 30 mm long tipping, wherein the heater footprint was 12 cm long and centered at the midpoint of the tobacco rod of each cigarette.

TABLE II

| | | | |
|---|---|---|---|
| Void Length (mm) | 4 | 7 | 10 |
| Heater overlap along the void (mm) | 1 | 4 | 7 |
| Heater overlap along the tobacco plug | 11 | 8 | 5 |
| Average TPM | 4.9 | 5.5 | 7.0 |
| Adjusted Average TPM (lowest reading omitted) | 5.2 | 5.9 | 7.3 |
| Standard Deviation of Adjusted Average | .34 | .53 | .50 |

Figure 9:
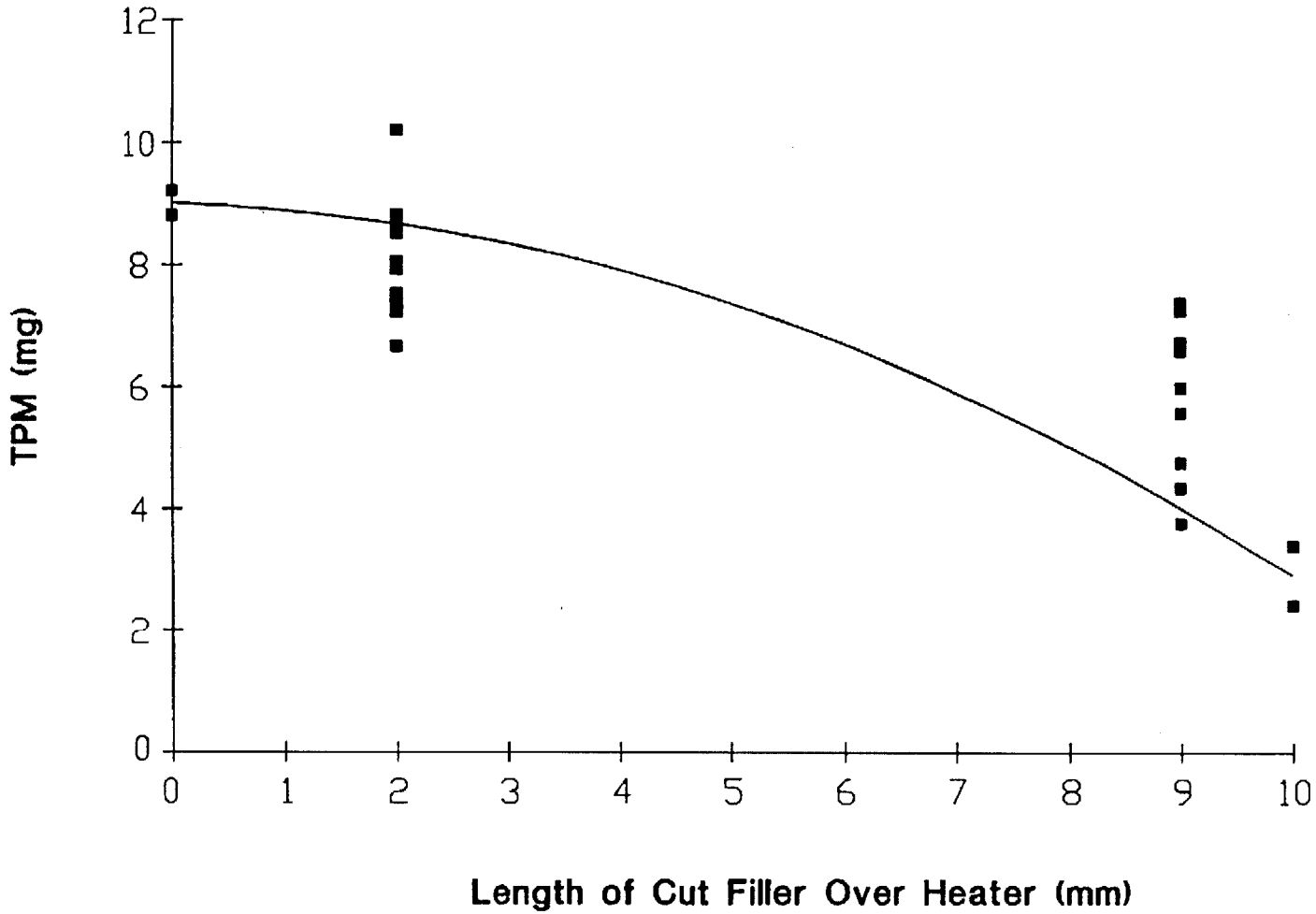
FIG. 9 is a graphical presentation of the relationship between the delivery of total particulate matter (TPM) and the amount of heater overlap over the filled portion of the partially filled cigarette constructed in accordance with the preferred embodiment (FIG. 4A) of the present invention.

FIG. 9 provides a graphical presentation of total particulate matter (TPM) delivered versus the amount of heater-filler overlap (in millimeters). The data shown therein was generated using standard testing techniques for determining FTC "tar" levels using Cambridge pads and two-second puff intervals on standard smoking machines. The tested cigarettes were partially-filled, filler cigarettes having a carbon fiber base web and a total length of 58 mm, except that the data appearing along the ordinate in FIG. 9 were obtained from a filler-free cigarette having a carbon fiber base web and the same total length. As the heater-tobacco overlap was varied, the heater footprint remained a constant length and remained centered upon the mid-point of the tobacco rod. Accordingly, any increase in heater-tobacco overlap created a proportional decrease in heater-void overlap. The heater was a serpentine type having a heater footprint of approximately 10 mm. All the data taken together indicates that a second order relationship exists in these circumstances between total particulate matter delivered and the amount of heater-filler overlap. The data presented in FIG. 9 and the separate set of data set forth in Table II show that the amount of heater-filler overlap may be adjusted to obtain a desired (target) level of delivery in a partially-filled, filler cigarette 23.

Adjusting the amount of heater-filler overlap is the preferred method of achieving a desired "tar" level in partially filled, filler cigarettes, for reasons including the finding that changes in heater-filler overlap have a more pronounced and controllable effect on delivery than do changes in rod density at the tobacco plug 80. Also, this approach allows one to select rod density in the tobacco plug 80 for purposes other than tar level, such as to control loose ends and/or to create a desired degree of pressure drop and/or filtration at the free end 78 of the tobacco rod 60, or otherwise facilitate manufacturing. It also provides the capacity to alter tar delivery amongst related cigarette products without having to necessarily change either the tobacco web 66 or the tobacco plug 80.

It is also advantageous to configure the relative dimensions of the partially-filled, filler cigarette 23 and those of the heater fixture 39 of the lighter 21 such that upon insertion of the cigarette 23 into the lighter 21, each heater element 37 locates alongside the tobacco rod 60 such that at least some, if not all of the heater footprints superpose only the filled portion of the tobacco rod 60 (over the tobacco plug 80). In such configurations, the void 91 still facilitates aerosol formation and helps cool the smoke. It is believed that the free-flow filter 74 helps promote aerosol formation by its presenting a flow constriction to the aerosol constituents as they are being drawn from the wider void 91. In this regard, it is to be noted that the free-flow filter 74 of the tobacco rod 60 presents edges 73 and 75 at the transitions between it and the void 91 on one side and between it and the free-flow filter 102 on the other, respectively. These edges 73 and 75 are a consequence of the free-flow filter 74 having a smaller inside radius than either of the other two, adjacent regions (the void 91 and space enclosed within the flee-flow filter 102). It is believed that these edges 73 and 75 (and possibly other, adjacent portions of the free-flow filter 74) promote turbulence and other flow conditions favorable to the formation of an aerosol from the gas-phase and particulate phase constituents released from the heated tobacco portions of the tobacco rod 60.

Figure 10:
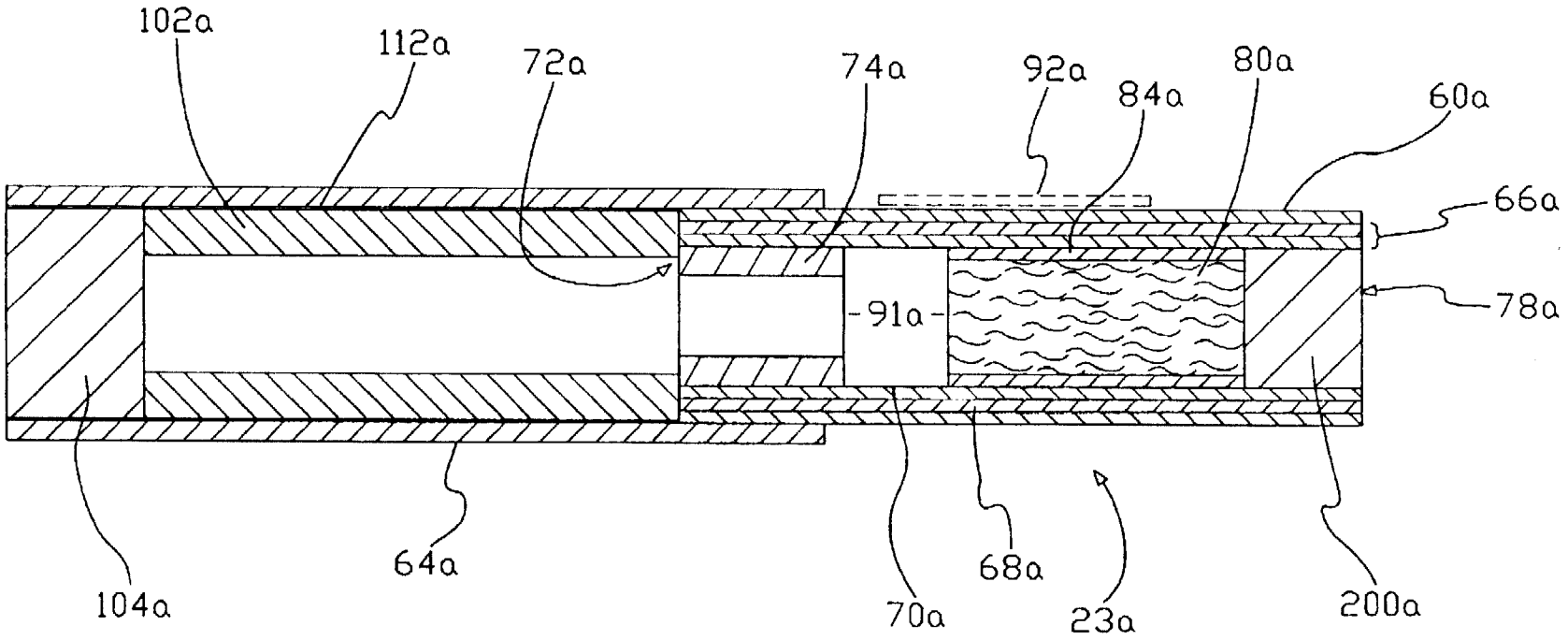
FIG. 10 is a cross-sectional side view of a cigarette constructed in accordance with a second preferred embodiment of the present invention.

Referring now to FIG. 10, a cigarette 23*a* is constructed in accordance with another preferred embodiment of the present invention having components and arrangements the same as set forth in the discussion of cigarette 23 in view of FIG. 4A, but with the addition of a back-flow filter 200*a* located at the free end 78*a* of the tobacco rod 60*a*. The back flow filter 200*a* prevents tobacco from the tobacco plug 80*a* from escaping at the free end 78*a*. The free flow filter 200*a* may as well be colored so as to indicate that the cigarette 23*a* is one for use in an electrical smoking device instead of one for being ignited with a match or a conventional cigarette lighter as with more traditional cigarettes. Although the back flow filter 200*a* is shown as a separate component of the wrapped tobacco plug 80*a*, one may for convenience in the manufacture of the cigarette 23*a* combine the tobacco plug 80*a* with the back flow filter 200*a* with a plug wrap (not shown). With the back flow filter plug, the cigarette 23*a* may be provided with a tobacco plug 80*a* having a low rod density without risking problems such as loose ends or tobacco falling out of the tobacco rod 60*a*. As revealed in commonly assigned U.S. Pat. No. 5,505,214 and in commonly assigned U.S. Pat. No. 5,388,594, the backflow filter 200*a* is configured to limit or wholly prevent the release of aerosol from the free end 78*a* of the tobacco rod 60*a* at the conclusion of a puff and to create a pressure drop at the free end 78*a* so as to favorably limit the amount of air that is drawn into the cigarette 23*a* from the free end 78*a* in relation to the proportional amount of air admitted along the sides of the tobacco rod 60*a*.

With regard to design techniques for the partially filled, filler cigarette 23 of the preferred embodiment, heater energies and the amount of heater-filler overlap can be used to establish and/or adjust delivery to a desired "tar" level. Accordingly, in the course of designing a new partially filled, filler cigarette 23, a selection of rod density in the tobacco plug 80 is generally available for achieving a desired degree of pressure drop at the free end 78 and/or to control backflow, in the same manner as is achieved with a backflow filter 200*a* of the alternate embodiment 23*a*.

Figure 11:
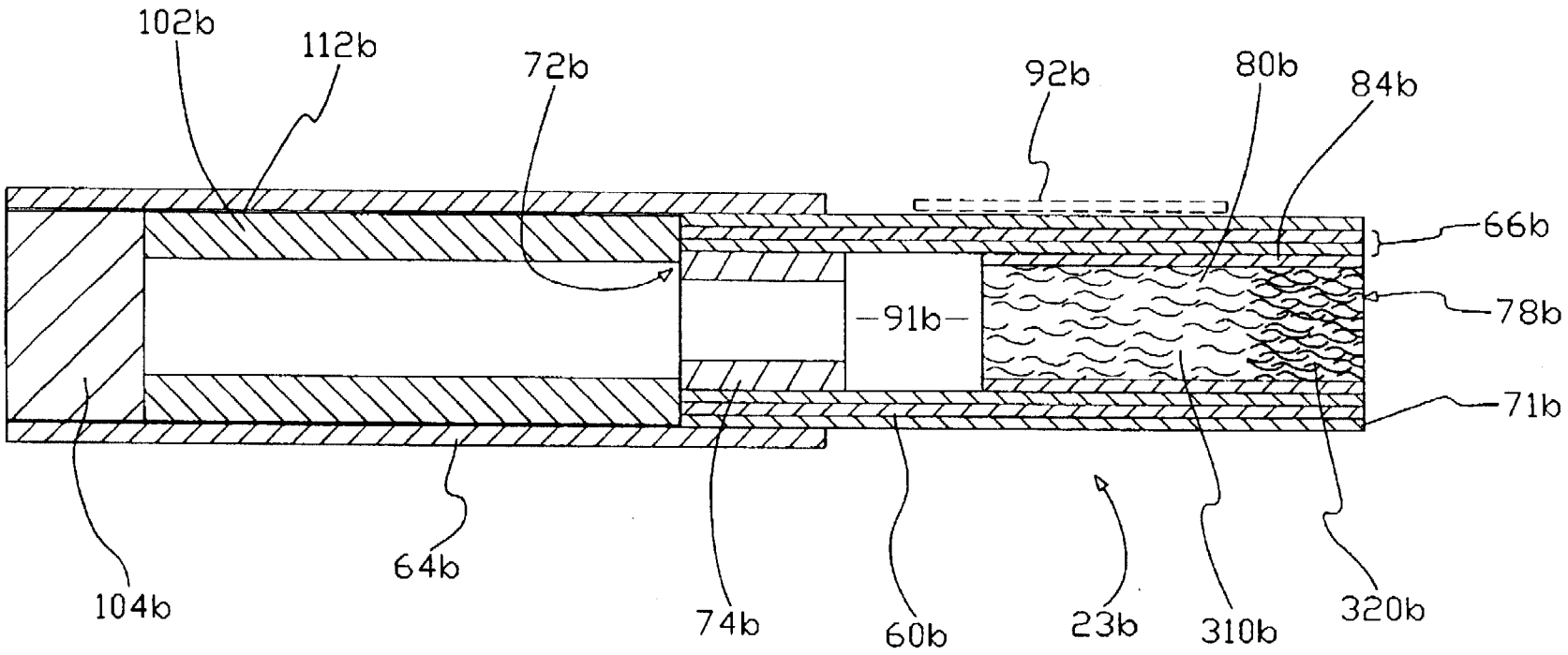
FIG. 11 is a cross-sectional side view of a cigarette constructed in accordance with a third preferred embodiment of the present invention.

Referring now to FIG. 11, another cigarette 23*b* constructed in accordance with another preferred embodiment of the present invention includes a tobacco plug 80*b* which comprises a low density portion 310*b* adjacent the void 91*b* and a high density portion 320*b* adjacent the free end 78*b* of the cigarette rod 60*b*. The cigarette 23*b* is configured such that the heater footprint 94B overlaps the low density portion 310*b* of the tobacco plug 80*b* so as to obtain enhanced delivery achievable with the lower rod densities. The high density region of cut filler 320*b* is arranged to avoid loose ends and to limit transmission of air axially through the rod 60*b* in a manner analogous to the backflow filter 200*a*.

Many modifications, substitutions and improvements may be apparent to the skilled artisan without departing from the spirit and scope of the present invention as described and defined herein and in the following claims.

What is claimed is:

1. An electrical smoking system comprising:

a cigarette comprising a tube partially filled with cut filler tobacco so as to define a filled tobacco rod portion and an unfilled tobacco rod portion; and a lighter comprising an electrical heater element and a system for electrically actuating said heater element, said lighter arranged to at least partially receive said cigarette;

said cigarette and said lighter being mutually arranged so that said electrical heater element of the lighter at least partially superposes at least one of the filled and unfilled tobacco rod portions when the cigarette is received in said lighter;

wherein said cut filler tobacco comprises a plug of cut filler tobacco:

wherein said cigarette has a free end, said tobacco plug being located adjacent said free end, said cigarette including a tubular free-flow filter spaced apart from said plug of tobacco so as to define said unfilled tobacco rod portion between said free-flow filter and said plug of tobacco.

2. The cigarette as claimed in claim 1, wherein said plug of tobacco includes a plug wrap disposed about said cut filler tobacco.

3. The cigarette as claimed in claim 1, wherein said tube is formed with a tobacco web and a tobacco flavor material is located along an inside surface of said tobacco web.

4. The cigarette as claimed in claim 3, wherein said tobacco rod further comprises an overwrap disposed about an outside surface of said filled and unfilled tobacco rod portions.

5. The cigarette as claimed in claim 1, wherein said free-flow filter is constructed from a plasticized tow material.

6. The cigarette as claimed in claim 1, wherein said free-flow filter is constructed from a molded material.

7. The cigarette as claimed in claim 1, further comprising filter tipping adjacent said free flow filter.

8. The cigarette as claimed in claim 7, wherein said tipping comprises a second free flow filter adjacent said free flow filter, said cigarette further comprising tipping paper attaching said second free-flow filter with said free flow filter.

9. The cigarette as claimed in claim 8, wherein said tipping further comprises a mouthpiece filter plug adjacent said second free-flow filter.

10. The cigarette as claimed in claim 9, wherein said free-flow filter of said tobacco rod includes a first passage and said second free flow filter of said tipping includes a second passage, said first and second passages communicating said unfilled space of said tobacco rod with said mouthpiece filter plug, said second passage having a second inside radius greater than a first inside radius of said first passage.

11. The cigarette as claimed in claim 1, further comprising a backflow filter at said free end.

12. The cigarette as claimed in claim 1, wherein said plug of tobacco includes a first portion adjacent said free end which has a higher density than a second portion of said plug of tobacco distal from said free end.

13. The cigarette as claimed in claim 1, wherein said plug of tobacco comprises a blend of cut filler tobacco, said blend comprising a combination of at least two of bright, burley and oriental tobaccos.

14. The cigarette as claimed in claim 1, wherein said electrical heater superposes at least a portion of said unfilled space and superposes at least a portion of said plug of tobacco when the cigarette is in said operative position in the lighter.

* * * * *